US011777221B2

(12) United States Patent
Ueda et al.

(10) Patent No.: US 11,777,221 B2
(45) Date of Patent: Oct. 3, 2023

(54) ANTENNA MODULE

(71) Applicant: Murata Manufacturing Co., Ltd., Kyoto (JP)

(72) Inventors: Hideki Ueda, Kyoto (JP); Kaoru Sudo, Kyoto (JP); Kengo Onaka, Kyoto (JP); Hirotsugu Mori, Kyoto (JP); Takaki Murata, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 149 days.

(21) Appl. No.: 17/076,239

(22) Filed: Oct. 21, 2020

(65) Prior Publication Data

US 2021/0036428 A1 Feb. 4, 2021

Related U.S. Application Data

(63) Continuation of application No. PCT/JP2019/016476, filed on Apr. 17, 2019.

(30) Foreign Application Priority Data

Apr. 26, 2018 (JP) ..... 2018-085146
Sep. 3, 2018 (JP) ..... 2018-164421

(51) Int. Cl.
*H01Q 13/08* (2006.01)
*H01Q 21/06* (2006.01)
(Continued)

(52) U.S. Cl.
CPC ..... *H01Q 13/08* (2013.01); *H01Q 5/307* (2015.01); *H01Q 5/378* (2015.01); *H01Q 21/065* (2013.01); *H01Q 21/28* (2013.01)

(58) Field of Classification Search
CPC ..... H01Q 13/08; H01Q 5/307; H01Q 5/378; H01Q 21/065; H01Q 21/28; H01Q 1/28; H01Q 5/42; H01Q 9/0414; H01Q 21/0006
See application file for complete search history.

(56) References Cited

U.S. PATENT DOCUMENTS 6,154,176 A * 11/2000 Fathy ..... H01Q 9/0414 343/846
2008/0158054 A1 7/2008 Yong et al.
(Continued)

FOREIGN PATENT DOCUMENTS

JP H02-164108 A 6/1990
JP H04-35208 A 2/1992
(Continued)

OTHER PUBLICATIONS

International Search Report for PCT/JP2019/016476 dated Jul. 16, 2019.
(Continued)

*Primary Examiner* — Hai V Tran
*Assistant Examiner* — Michael M Bouizza
(74) *Attorney, Agent, or Firm* — Pearne & Gordon LLP

(57) ABSTRACT

A plurality of multi-band antenna elements operable at a plurality of frequencies constitutes an array antenna. An antenna drive unit selects at least some of the multi-band antenna elements from the plurality of multi-band antenna elements in accordance with one operation frequency selected from the plurality of operation frequencies, and causes the selected multi-band antenna elements to operate.

16 Claims, 18 Drawing Sheets

(51) Int. Cl.

| | |
|---|---|
| ***H01Q 21/28*** | (2006.01) |
| ***H01Q 5/307*** | (2015.01) |
| ***H01Q 5/378*** | (2015.01) |

(56) References Cited

U.S. PATENT DOCUMENTS

| | | | | |
|---|---|---|---|---|
| 2015/0318622 | A1 | 11/2015 | Pruett et al. | |
| 2018/0159215 | A1 | 6/2018 | Suzuki et al. | |
| 2019/0020110 | A1* | 1/2019 | Paulotto | H01Q 9/0414 |
| 2019/0020121 | A1* | 1/2019 | Paulotto | H01Q 21/28 |
| 2020/0006864 | A1* | 1/2020 | Naruse | H01Q 21/065 |

FOREIGN PATENT DOCUMENTS

| | | | |
|---|---|---|---|
| JP | 2000-174552 | A | 6/2000 |
| JP | 2001-189623 | A | 7/2001 |
| JP | 2008-167401 | A | 7/2008 |
| JP | 2010-226633 | A | 10/2010 |
| WO | 2016/181793 | A1 | 11/2016 |

OTHER PUBLICATIONS

Written Opinion for for PCT/JP2019/016476 dated Jul. 16, 2019.
Notice of Reasons for Rejection for Japanese Patent Application No. 2020-516271 dated May 18, 2021.

* cited by examiner

ANTENNA MODULE

CROSS REFERENCE TO RELATED APPLICATIONS

This is a continuation of International Application No. PCT/JP2019/016476 filed on Apr. 17, 2019 which claims priority from Japanese Patent Application No. 2018-085146 filed on Apr. 26, 2018, and claims priority from Japanese Patent Application No. 2018-164421 filed on Sep. 3, 2018. The contents of these applications are incorporated herein by reference in their entireties.

BACKGROUND OF THE DISCLOSURE

Field of the Disclosure

The present disclosure relates to an antenna module.

Description of the Related Art

An array antenna system capable of quickly forming a beam pattern conforming to a communication direction of a radio signal is disclosed in Patent Document 1 below. The array antenna system includes a plurality of antenna elements arranged at predetermined intervals in a row direction and a column direction, and control means configured to selectively operate at least two antenna elements among the plurality of antenna elements along the direction of a radio signal to be received.

Patent Document 2 below discloses a microstrip antenna in which a plurality of antenna elements (patches) is laminated, and a coaxial power feeding portion is provided to each antenna element. The microstrip antenna is capable of supporting two or multiple frequencies by antenna elements in a plurality of layers.

Patent Document 1: Japanese Unexamined Patent Application Publication No. 2008-167401

Patent Document 2: Japanese Unexamined Patent Application Publication No. 2010-226633

BRIEF SUMMARY OF THE DISCLOSURE

The array antenna system disclosed in Patent Document 1 is capable of forming a suitable beam pattern in accordance with a communication direction of a radio signal at a specific frequency, but is not capable of supporting a plurality of radio signals (radio waves) of different frequencies.

When the array antenna is constituted of the microstrip antenna disclosed in Patent Document 2, it is possible to support two frequencies or multiple frequencies by antenna elements in a plurality of layers. However, when the interval between radiating elements is made suitable in one frequency band, the interval between the radiating elements may be deviated from a suitable range in other frequency bands.

An object of the present disclosure is to provide an antenna module capable of supporting a plurality of frequencies and capable of making the interval between the radiating elements suitable at each frequency.

According to one aspect of the present disclosure, there is provided an antenna module including:

a plurality of multi-band antenna elements configured to constitute an array antenna and operable at a plurality of operation frequencies; and an antenna drive unit configured to select at least two multi-band antenna elements among the plurality of multi-band antenna elements in accordance with one operation frequency selected from the plurality of operation frequencies, and to cause the multi-band antenna elements that are selected among the plurality of multi-band antenna elements to operate.

By selecting the combination of the multi-band antenna elements to be operated in accordance with the operation frequency, it is possible to set the interval between the multi-band antenna elements to be operated to a preferred value.

15C are sectional views illustrating antenna modules according to modifications of the eighth embodiment.

Figure 16A:
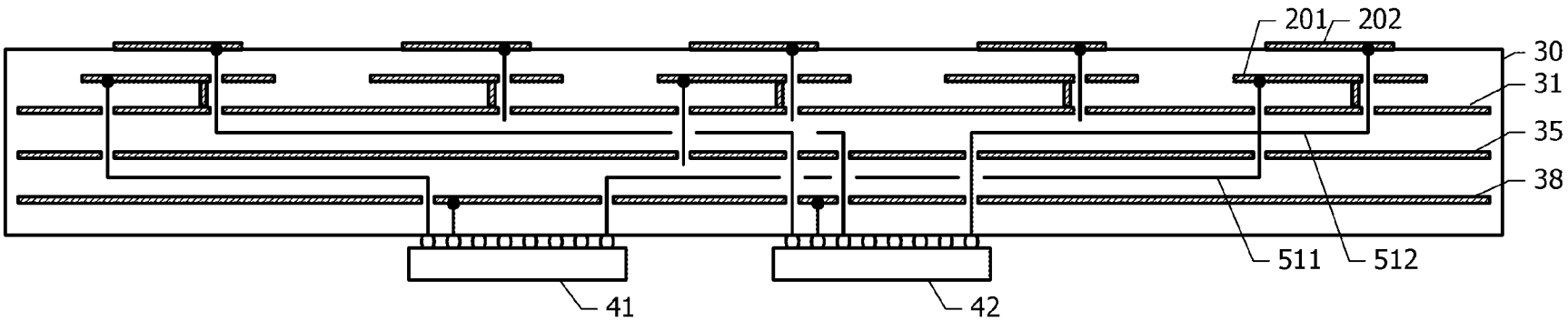
Figure 16B:
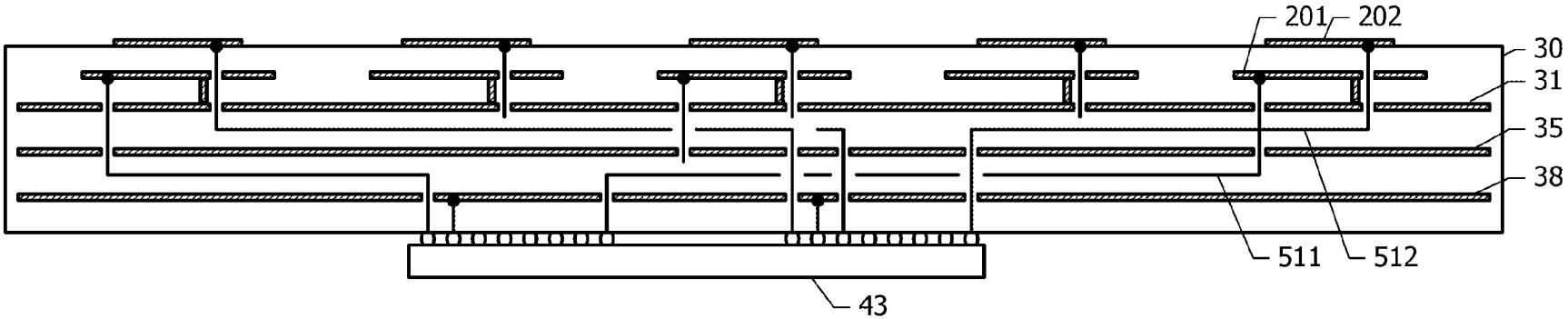

FIG. 16A and FIG. 16B are sectional views of antenna modules according to a ninth embodiment and a first modification thereof, respectively.

Figure 17:
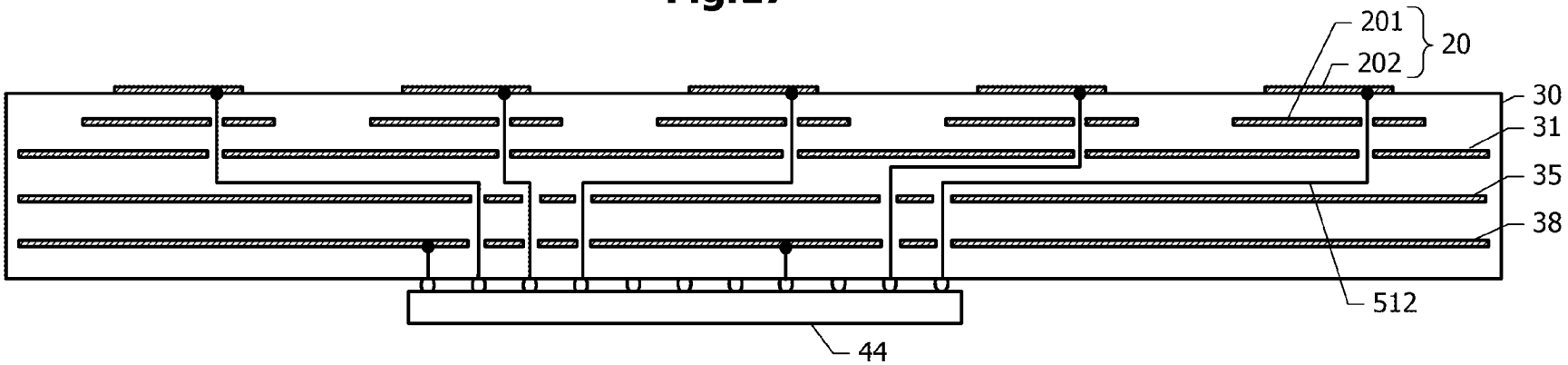

FIG. 17 is a sectional view of an antenna module according to a second modification of the ninth embodiment.

Figure 18:
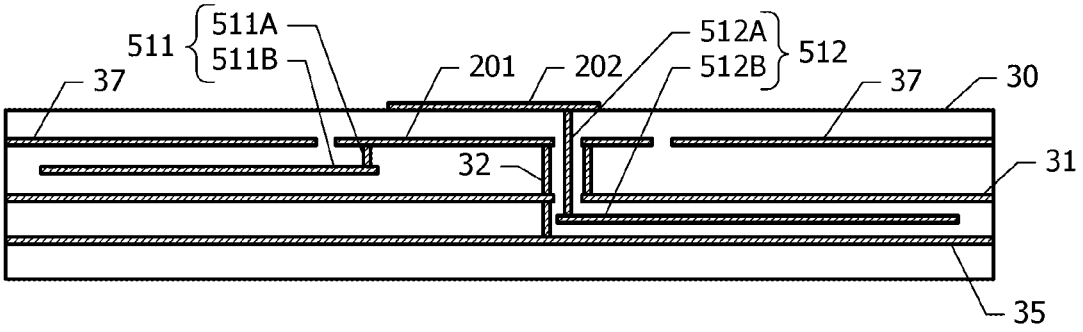

FIG. 18 is a sectional view of an antenna module according to a reference example.

DETAILED DESCRIPTION OF THE DISCLOSURE

First Embodiment

An antenna module according to a first embodiment will be described with reference to the drawings in FIG. 1A to FIG. 6B.

Figure 1A:
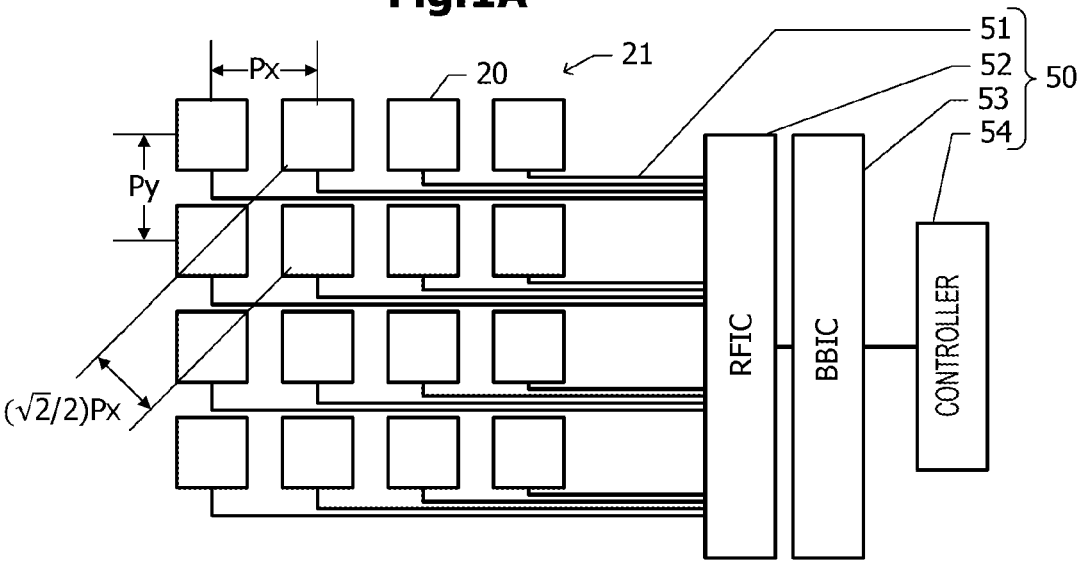
FIG. 1A is a schematic view of an antenna module according to a first embodiment.

FIG. 1A is a schematic diagram of the antenna module according to the first embodiment. The antenna module according to the first embodiment includes a plurality of multi-band antenna elements 20 (unit antennas) and an antenna drive unit 50. Each of the plurality of multi-band antenna elements 20 is operable at a plurality of frequencies. The plurality of multiband antenna elements 20 is arranged in a two-dimensional matrix with four rows and four columns, for example, and constitutes an array antenna 21. It should be noted that the number of rows and the number of columns are not limited to four. A pitch Px in the row direction and a pitch Py in the column direction between the multi-band antenna elements 20 are equal to each other. The pitch in a 45° oblique direction becomes $((2^{1/2})/2)Px$. Here, the "pitch in oblique direction" does not refer to the pitch of two multi-band antenna elements 20 adjacent to each other in oblique direction, but refers to the pitch of lines when focusing on a plurality of lines constituted of the multi-band antenna elements 20 arranged in oblique direction. The pitch Px in the row direction and the pitch Py in the column direction are the largest among the pitches in various directions. It is preferable that the pitch Px and the pitch Py be smaller than the free space wavelength determined by the highest operation frequency among the plurality of operation frequencies. For example, when the highest operation frequency is 39 GHz, the free space wavelength determined by the frequency is about 7.7 mm. Therefore, it is preferable that the pitch Px and the pitch Py be set to be equal to or less than 7.7 mm.

The antenna drive unit 50 includes a plurality of feed lines 51, a radio frequency integrated circuit element 52, a baseband integrated circuit element 53, and a controller 54. The baseband integrated circuit element 53 performs baseband signal processing. The radio frequency integrated circuit element 52 performs signal processing for radio frequency band. The controller 54 selects one operation frequency for the array antenna 21 to be operated from a plurality of operation frequencies. Furthermore, a combination of multi-band antenna elements 20 to be operated is determined from the plurality of multi-band antenna elements 20 in accordance with the selected operation frequency. Upon determining the combination of the multi-band antenna elements 20 to be operated, the controller 54 outputs a selection signal for specifying the combination of the multi-band antenna elements 20 to be operated to the radio frequency integrated circuit element 52. The controller 54 stores the combination of the multi-band antenna elements 20 to be operated corresponding to each of the plurality of operation frequencies. The radio frequency integrated circuit element 52 has a function of feeding power to the selected multi-band antenna elements 20, and not feeding power to the remaining multi-band antenna elements 20.

Figure 1B:
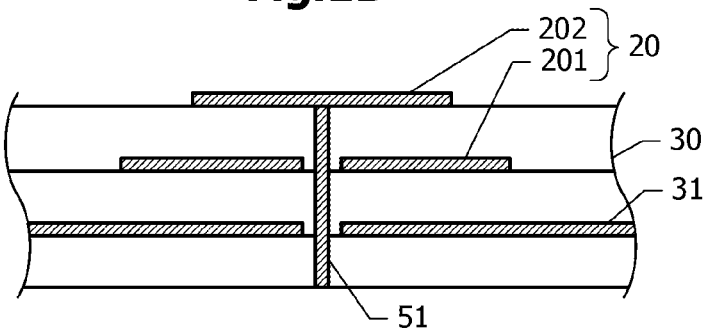
FIG. 1B is a sectional view illustrating an example of one multi-band antenna element.

FIG. 1B is a sectional view illustrating an example of one multi-band antenna element 20. The multi-band antenna element 20 is provided in or on a dielectric substrate 30. In the present description, the thickness direction of the dielectric substrate 30 corresponds to the up-down direction. A first ground conductor layer 31 is provided in the dielectric substrate 30. The multi-band antenna element 20 is disposed at a position different from that of the first ground conductor layer 31 in the thickness direction of the dielectric substrate 30. A direction from the first ground conductor layer 31 toward the multi-band antenna element 20 is defined as an "upward direction", and an opposite direction thereof is defined as a "downward direction". Each of the multi-band antenna elements 20 includes a plurality of conductor patterns, for example, a first conductor pattern 201 and a second conductor pattern 202. In plan view, the first conductor pattern 201 and the second conductor pattern 202 overlap with each other. For example, the second conductor pattern 202 is disposed inside the first conductor pattern 201.

The feed line 51 is coupled to the second conductor pattern 202. Specifically, the second conductor pattern 202 is electromagnetically coupled to the feed line 51. For example, the feed line 51 extends downward from a lower surface of the second conductor pattern 202 (surface facing downward direction), passes through a clearance hole provided in the first conductor pattern 201 and a clearance hole provided in the first ground conductor layer 31, and reaches a region below the first ground conductor layer 31. In the present description, the term "coupled" includes a coupling that is electrically directly connected, and an electromagnetic coupling.

The size of the first conductor pattern 201 and the size of the second conductor pattern 202 are different from each other, and resonate at mutually different frequencies. When the signal of the resonant frequency of the second conductor pattern 202 is supplied to the second conductor pattern 202 via the feed line 51 directly connected thereto, the multi-band antenna element 20 operates at the resonant frequency of the second conductor pattern 202. When the signal at the resonant frequency of the first conductor pattern 201 is supplied to the first conductor pattern 201 via the feed line 51 electromagnetically coupled thereto, the multi-band antenna element 20 operates at the resonant frequency of the first conductor pattern 201. Accordingly, the multi-band antenna element 20 operates at two different frequencies that are the resonant frequency of the first conductor pattern 201 and the resonant frequency of the second conductor pattern 202.

Figure 2:
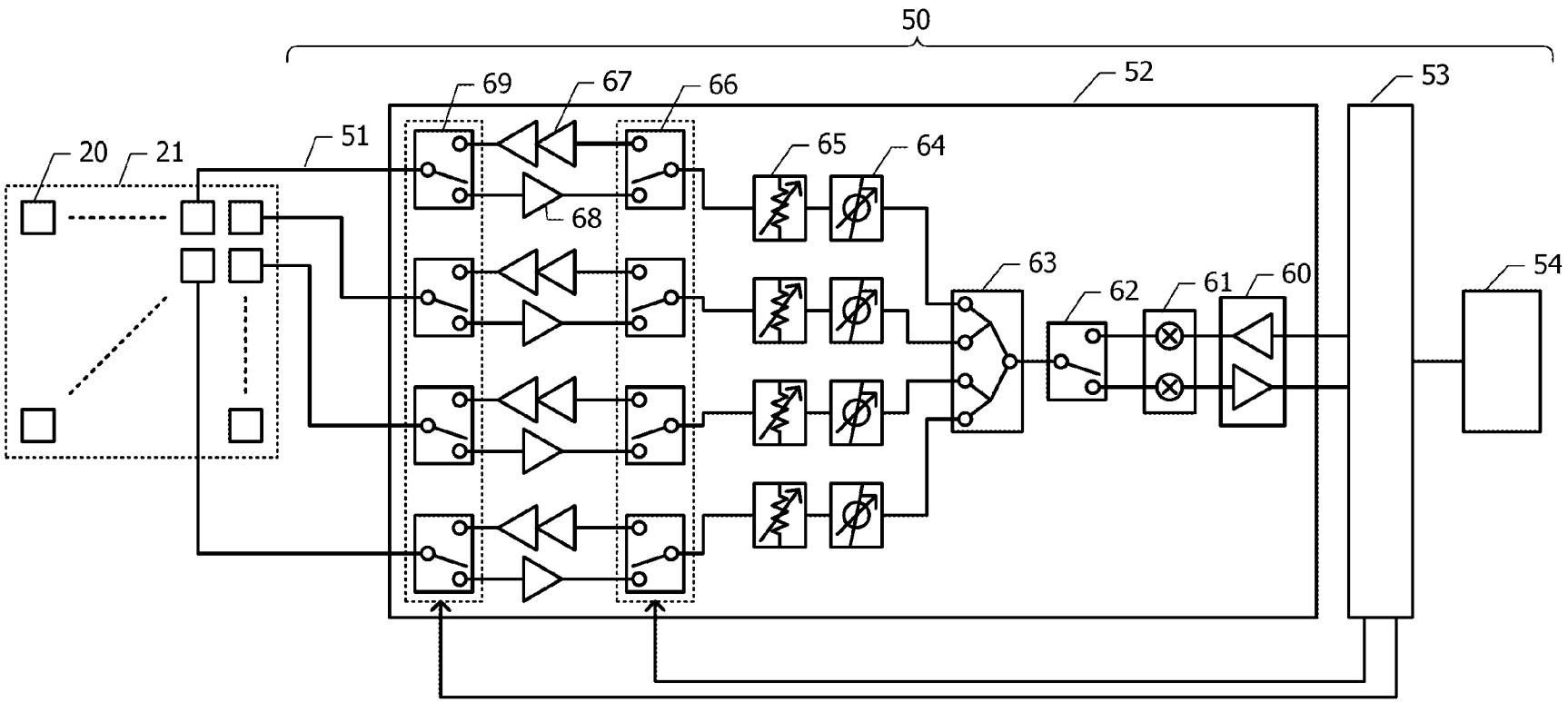
FIG. 2 is a block diagram of the antenna module according to the first embodiment.

FIG. 2 is a block diagram of the antenna module according to the first embodiment. Hereinafter, the function of the antenna drive unit 50 will be described.

An intermediate frequency signal is inputted from the baseband integrated circuit element 53 to an up-down conversion mixer 61 via an intermediate frequency amplifier 60. A radio frequency signal up-converted by the up-down conversion mixer 61 is inputted to a power divider 63 via a transmission/reception changeover switch 62. Each of the radio frequency signals obtained by division by the power divider 63 is inputted to the multi-band antenna element 20 via a phase shifter 64, an attenuator 65, a transmission/reception changeover switch 66, a power amplifier 67, a transmission/reception changeover switch 69, and the feed line 51.

The radio frequency signal received by each of the multi-band antenna elements 20 is inputted to the power divider 63 via the feed line 51, the transmission/reception changeover switch 69, a low-noise amplifier 68, the transmission/reception changeover switch 66, the attenuator 65, and the phase shifter 64. The radio frequency signal combined by the power divider 63 is inputted to the up-down conversion mixer 61 via the transmission/reception changeover switch 62. The intermediate frequency signal down-converted by the up-down conversion mixer 61 is inputted to the baseband integrated circuit element 53 via the intermediate frequency amplifier 60.

The radio frequency integrated circuit element 52 includes transmission/reception changeover switches 62, 66, and 69, the power amplifier 67, the low-noise amplifier 68, the attenuator 65, the phase shifter 64, the power divider 63, the up-down conversion mixer 61, and the intermediate frequency amplifier 60. Note that it is acceptable that the transmission/reception changeover switches 62, 66, and 69, the power amplifier 67, the low-noise amplifier 68, the attenuator 65, the phase shifter 64, and the power divider 63 are configured in an integrated manner, and the up-down conversion mixer 61 and the intermediate frequency amplifier 60 are in a separate chip.

The controller 54 outputs a selection signal for specifying the combination of the multi-band antenna elements 20 to be operated to the baseband integrated circuit element 53. The selection signal is outputted to the radio frequency integrated circuit element 52 via the baseband integrated circuit element 53, and the states of the transmission/reception changeover switches 66 and 69 are switched by the selection signal. Each of the transmission/reception changeover switches 66 and 69 is set to one of three states that are a transmission state, a reception state, and a neutral state. The multi-band antenna elements 20 corresponding to the transmission/reception changeover switches 66 and 69 set to the transmission state or the reception state are in an operation state. The multi-band antenna elements 20 corresponding to the transmission/reception changeover switches 66 and 69 set to the neutral state are in a non-operation state. No power is fed to the multi-band antenna elements 20 in the non-operation state. The transmission/reception changeover switches 66 and 69 are for the time division duplexing communication (TDD) scheme.

Next, a combination of the multi-band antenna elements 20 to be in the operation state will be described with reference to FIG. 3A and FIG. 3B.

Figure 3A:
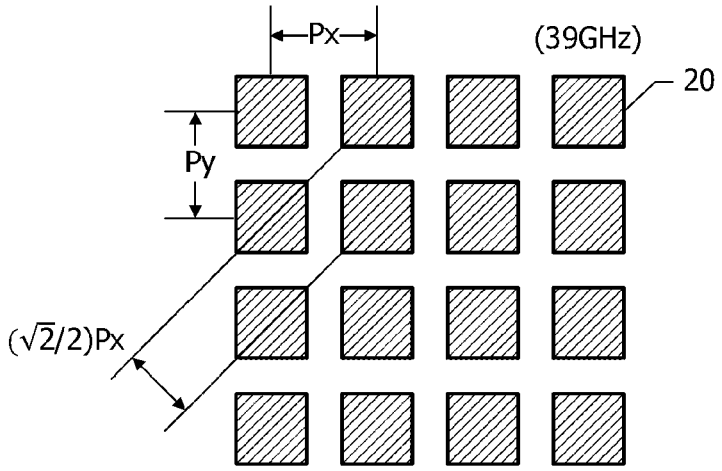
FIG. 3A and FIG. 3B are diagrams illustrating multi-band antenna elements in an operation state when 39 GHz and 28 GHz are selected as operation frequencies, respectively.
Figure 3B:
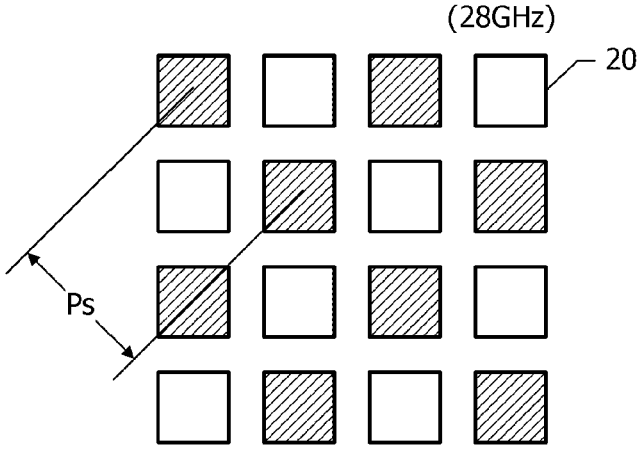

FIG. 3A and FIG. 3B are diagrams illustrating multi-band antenna elements 20 in the operation state when 39 GHz and 28 GHz are selected as operation frequencies, respectively. In FIG. 3A and FIG. 3B, the multi-band antenna elements 20 in the operation state are hatched.

When 39 GHz is selected as the operation frequency, all of the multi-band antenna elements 20 are operated as illustrated in FIG. 3A. At this time, the pitch Px in the row direction and the pitch Py in the column direction each correspond to the maximum value of the pitch of the multi-band antenna elements 20 in the operation state, and the value thereof is 3.8 mm. When 28 GHz is selected as the operation frequency, as illustrated in FIG. 3B, the multi-band antenna elements 20 in the operation state are distributed in a checkered pattern. At this time, the pitch Ps in the oblique direction corresponds to the maximum value of the pitch of the multi-band antenna elements 20 in the operation state, and the value thereof is 5.4 mm. In either case, the maximum value of the pitch of the multi-band antenna elements 20 in the operation state is about ½ of the free space wavelength determined by the operation frequency. With this configuration, the angle in which beamforming is possible expands, and side lobes are suppressed.

Figure 4:
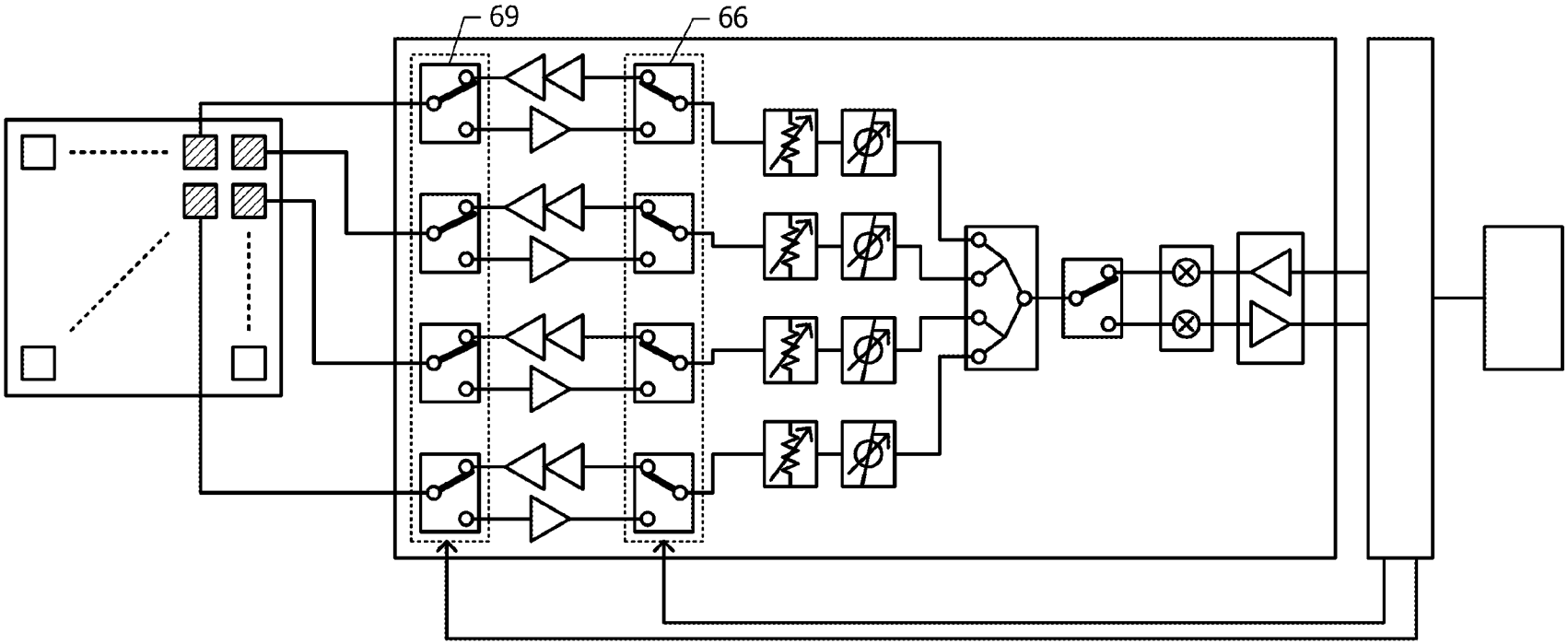
FIG. 4 is a block diagram of the antenna module in the operation state illustrated in FIG. 3A when the antenna module is in a transmission state.

FIG. 4 is a block diagram of the antenna module in the operation state illustrated in FIG. 3A when the antenna module is in the transmission state. All of the transmission/reception changeover switches 66 and 69 are set to the transmission state. Therefore, all of the multi-band antenna elements 20 are brought into the operation state. In order to switch the antenna module to be in the reception state, all of the transmission/reception changeover switches 66 and 69 are switched to the reception state.

Figure 5:
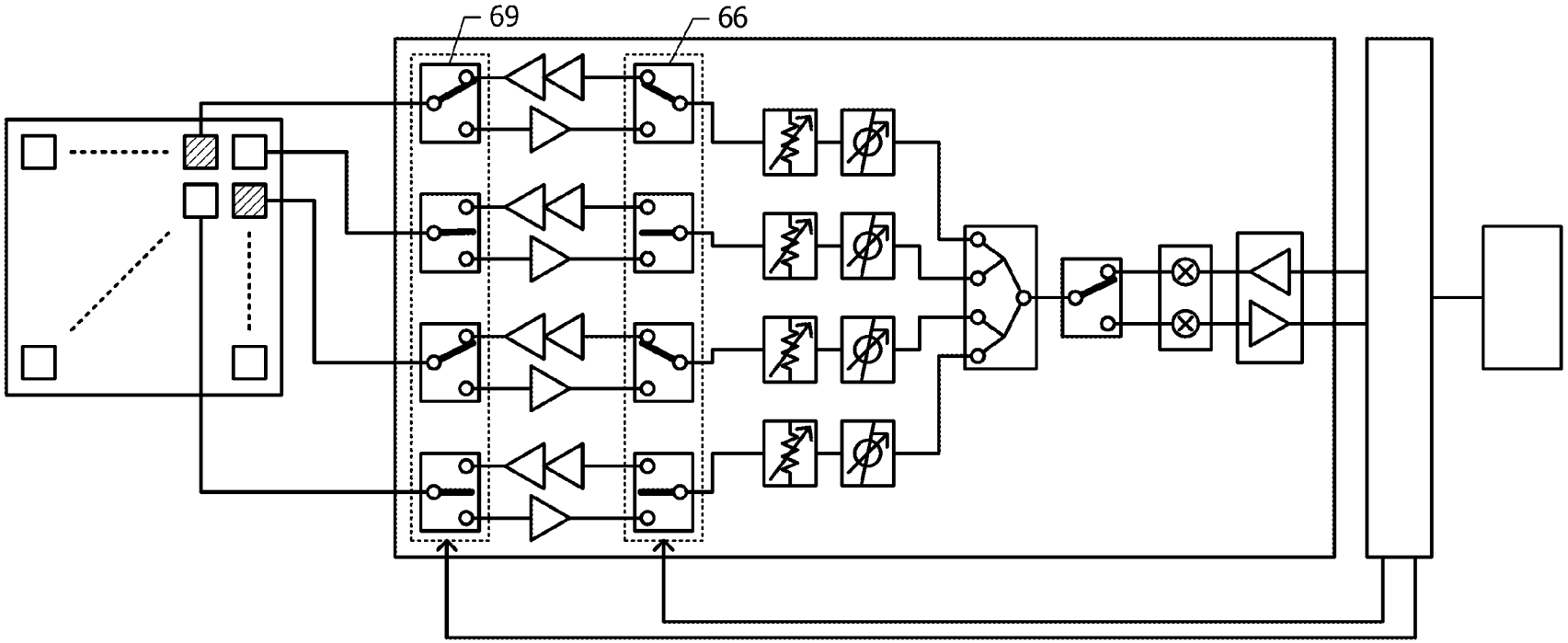
FIG. 5 is a block diagram of the antenna module in the operation state illustrated in FIG. 3B when the antenna module is in the transmission state.

FIG. 5 is a block diagram of the antenna module in the operation state illustrated in FIG. 3B when the antenna module is in the transmission state. The transmission/reception changeover switches 66 and 69 corresponding to the multi-band antenna elements 20 to be operated are set to the transmission state, and the transmission/reception changeover switches 66 and 69 corresponding to the multi-band antenna elements 20 not to be operated are set to the neutral state. With this configuration, no power is fed to the multi-band antenna elements 20 not to be operated. In order to switch the antenna module to be in the reception state, only the transmission/reception changeover switches 66 and 69 set to the transmission state need to be switched to the reception state. The multi-band antenna element 20 set to the neutral state may remain in the neutral state.

Next, an excellent effect of the first embodiment will be described with reference to the drawings in FIG. 6A to FIG. 8B. The directivity characteristic of the antenna module according to the first embodiment and an antenna module according to a comparative example were obtained by a simulation. The simulation will be described below.

Figure 6A:
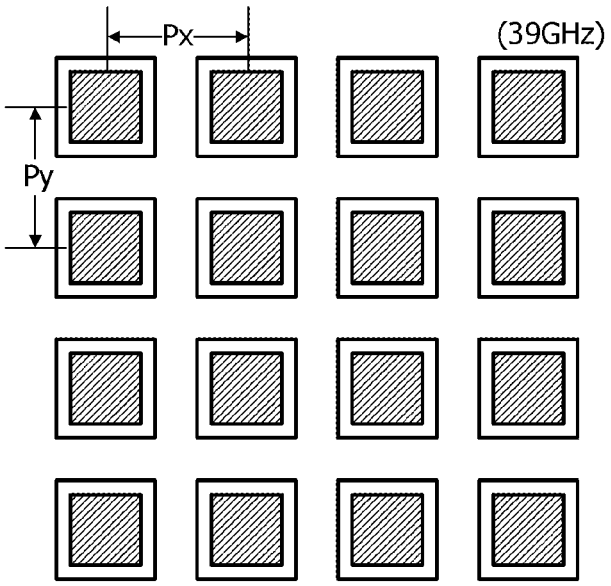
FIG. 6A and FIG. 6B are plan views when the antenna module according to the first embodiment which is the simulation target is operated at 39 GHz and 28 GHz, respectively.
Figure 6B:
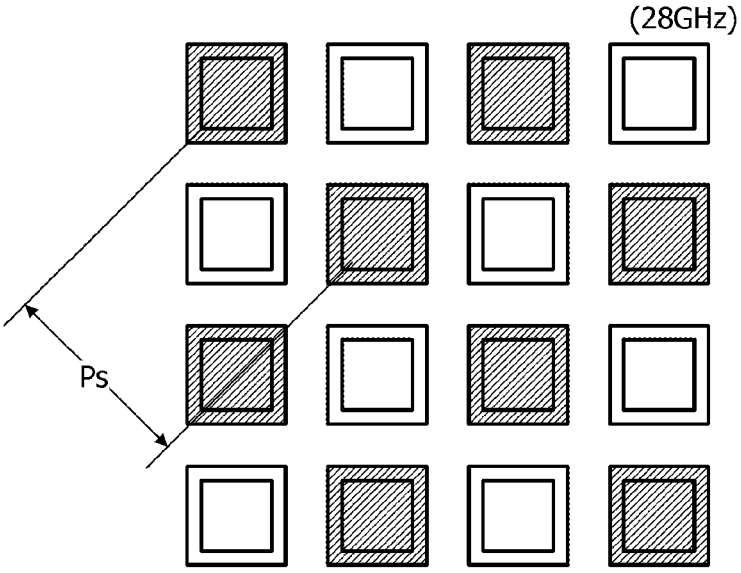

FIG. 6A and FIG. 6B are plan views of the simulation target antenna module according to the first embodiment. The multi-band antenna elements 20 are arranged in a matrix with four rows and four columns. The pitch Px in the row direction and the pitch Py in the column direction are both 3.8 mm. Each of the multi-band antenna elements 20 includes a radiation conductor pattern (patch) for 39 GHz, and a radiation conductor pattern (patch) for 28 GHz larger than that for 39 GHz.

When the multi-band antenna elements 20 are operated at 39 GHz, the power is fed to all of the radiation patterns for 39 GHz. In FIG. 6A, the radiation patterns that are power feed targets are hatched. When operated at 28 GHz, the radiation patterns that are power feed targets are selected such that the radiation patterns for 28 GHz that are power feed targets are arranged in a checkered pattern. In FIG. 6B, the radiation patterns that are power feed targets are hatched. The shortest pitch Ps in oblique direction is about 5.37 mm.

Figure 7A:
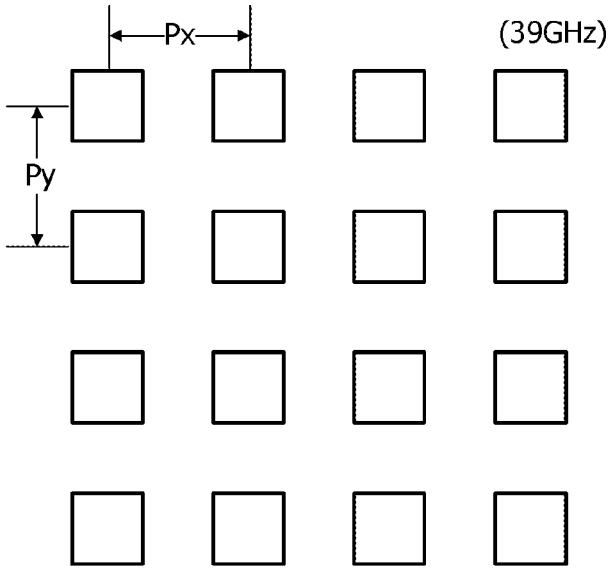
FIG. 7A and FIG. 7B are plan views of patch array antennas for 39 GHz and 28 GHz according to a comparative example, respectively.

FIG. 7A is a plan view of a patch array antenna for 39 GHz according to the comparative example. The patch antennas are arranged in a matrix with four rows and four columns. The pitch Px in the row direction and the pitch Py in the column direction are both 3.8 mm.

Figure 7B:
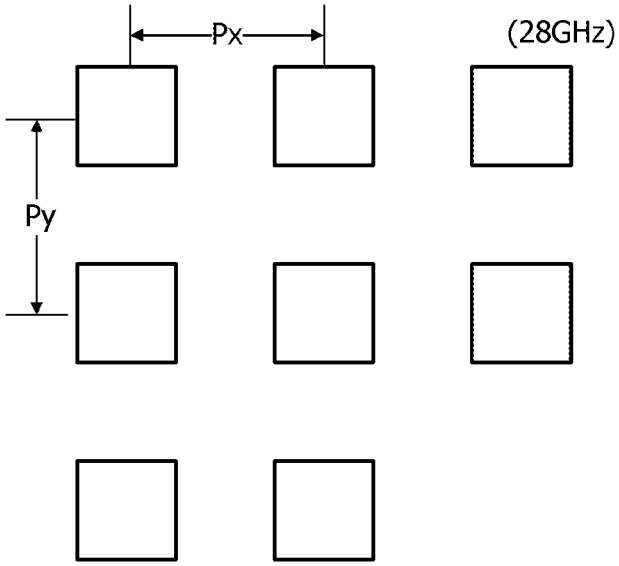

FIG. 7B is a plan view of a patch array antenna for 28 GHz according to the comparative example. The patch array antenna according to the comparative example is constituted of eight patch antennas. The patch array antenna is formed by removing one at a corner from nine patch antennas arranged in a matrix with three rows and three columns. The one patch at a corner is removed because the number of radiation patterns is to be matched to the number of the radiation patterns that are power feed targets in the antenna module according to the first embodiment (FIG. 6B). The pitch Px in the row direction and the pitch Py in the column direction are both 5.4 mm.

Figure 8A:
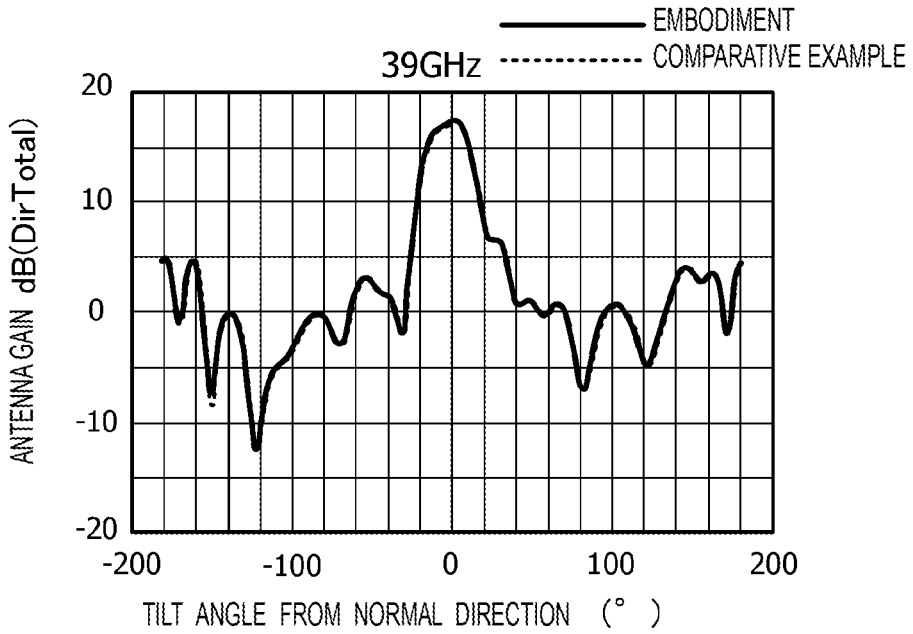
FIG. 8A and FIG. 8B are graphs illustrating simulation results of directivity characteristic of the antenna module according to the first embodiment and the comparative example at 39 GHz and 28 GHz, respectively.
Figure 8B:
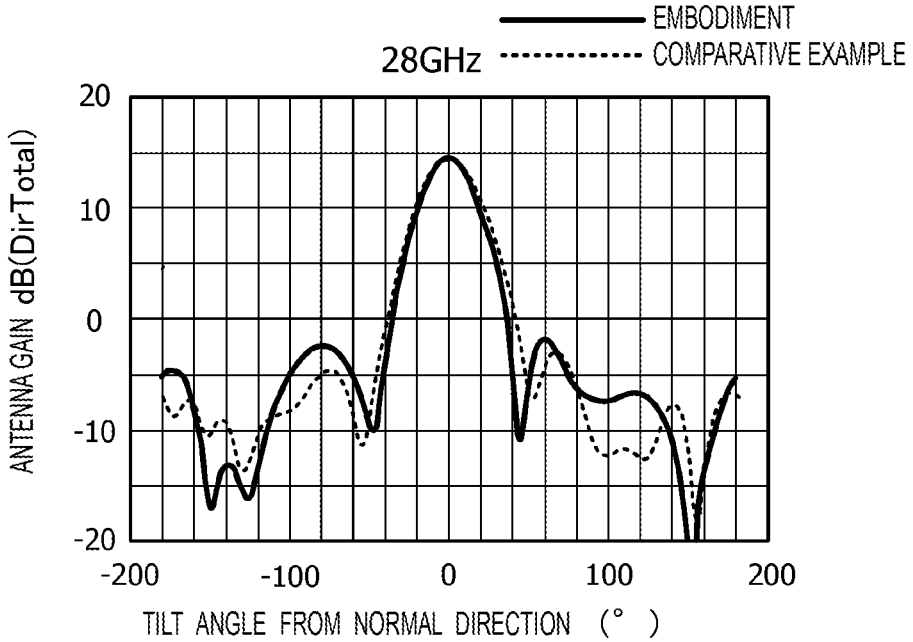

FIG. 8A and FIG. 8B are graphs describing the simulation results of directivity characteristic of the antenna modules according to the first embodiment and the comparative example. FIG. 8A describes the directivity characteristic when the operation frequency is 39 GHz (FIG. 6A and FIG. 7A), and FIG. 8B describes the directivity characteristic when the operation frequency is 28 GHz (FIG. 6B and FIG. 7B). In the horizontal axis of the graphs described in FIG. 8A and FIG. 8B, the tilt angle from the normal direction of a plane in which the multi-band antenna elements 20 are arranged to a row direction is expressed in the unit of "°", and in the vertical axis, an antenna gain is expressed in the unit of "dB (DirTotal)". In FIG. 8A and FIG. 8B, the solid line of the graph indicates the simulation result of the antenna gain of the antenna module according to the first embodiment. In FIG. 8A and FIG. 8B, the broken line of the graph indicates the simulation result of the antenna gain of the antenna module according to the comparative example.

As illustrated in FIG. 8A, it is found that when all of the multi-band antenna elements 20 of the antenna module according to the first embodiment are operated (FIG. 6A), the directivity characteristic substantially equivalent to that of the existing patch array antenna for 39 GHz (FIG. 7A) is obtained. As illustrated in FIG. 8B, it is found that when only some of the multi-band antenna elements of the antenna module according to the first embodiment is operated (FIG. 6B), the directivity characteristic substantially equivalent to that of the existing patch array antenna for 28 GHz (FIG. 7B) is obtained. That is, in the antenna module according to the first embodiment, without preparing two antenna arrays, it is possible to ensure the same performance as that of the configuration in which two antenna arrays are disposed. With this configuration, it is possible to reduce the size of the antenna module.

In the past, in the case of transmitting and receiving radio waves in two different frequencies, two patch array antennas having different pitches have to be prepared. In contrast, in the first embodiment, it is possible to transmit and receive radio waves in two different frequencies by making different combinations (grouping) of the multi-band antenna elements 20 to be operated in the one array antenna 21 (FIG. 1A). By making the combination of the multiple multi-band antenna elements 20 different, it is possible to make the pitch of the multi-band antenna elements 20 suitable in accordance with the operation frequency. For example, it is possible to set the pitch of the multi-band antenna elements 20 to about ½ of the free space wavelength determined by the operation frequency. As the result, it is possible to make the directivity characteristic, when the antenna module according to the first embodiment is operated at each frequency, substantially equal to the directivity characteristic of the existing patch array antenna.

It is preferable that the maximum value among the pitches between the multi-band antenna elements 20 in various directions be made smaller than the free space wavelength determined by the highest operation frequency among the plurality of operation frequencies. By configuring as described above, it is possible to suppress grating lobes, and it is possible to obtain an excellent effect that the aperture efficiency as an array antenna is increased. It is more preferable that the maximum value of the pitch of the multi-band antenna elements 20 be set to ½ or less of the free space wavelength determined by the highest operation frequency among the plurality of operation frequencies. By configuring as described above, it is possible to obtain an excellent effect that the beamforming may be effectively performed. That is, it is possible to obtain an excellent effect that the angle in which the beamforming is possible expands, and the side lobes are suppressed.

In the first embodiment, the plurality of multi-band antenna elements 20 is arranged in a matrix. By performing the selection from the plurality of multi-band antenna elements 20 arranged in a matrix and the phase control of each multi-band antenna element 20, it is possible to obtain an effect that the degree of freedom in beamforming is increased.

When a frequency other than the highest operation frequency among the plurality of operation frequencies is selected, it is preferable to select the multi-band antenna element 20 such that the maximum value of the pitch of the plurality of the multi-band antenna elements 20 to be selected becomes equal to or less than the free space wavelength determined by the selected operation frequency. When the multi-band antenna elements 20 to be operated are selected as described above, it is possible to suppress the grating lobes at the selected operation frequency, and it is possible to obtain an excellent effect that the aperture efficiency of the array antenna is increased. When the multi-band antenna elements 20 other than the selected multi-band antenna elements 20 are put in the non-operation state, the number of ports used by the radio frequency integrated circuit element 52 is decreased, and thus it is possible to reduce power consumption. Even when the power consumption is reduced, a decrease in the gain as an array antenna is small.

Next, a modification of the first embodiment will be described.

In the first embodiment, the plurality of multi-band antenna elements 20 is arranged in a two-dimensional matrix along a planer plane parallel to the surface of the dielectric substrate 30 (FIG. 1B), but the present disclosure is not limited to the planer plane, and the plurality of multi-band antenna elements 20 may be arranged along a spherical plane or an arbitrarily curved plane. For example, the plurality of multi-band antenna elements 20 may be disposed along a skin of a fuselage of an aircraft. Further, the plurality of multi-band antenna elements 20 may be arranged in a one-dimensional shape along a straight line or a curved line. When the plurality of multi-band antenna elements 20 is arranged along a planer plane, since the radiation directions of all of the multi-band antenna elements 20 are the same, an effect is obtained that the gain is increased. When the plurality of multi-band antenna elements 20 is arranged along a curved plane, since the radiation directions of the plurality of multi-band antenna elements 20 are oriented in various directions, an effect is obtained that the overall directivity is broadened. In the first embodiment, the plurality of multi-band antenna elements 20 is arranged at equal pitches, but it is not always necessary to arrange the plurality of multi-band antenna elements 20 at equal pitches. The array antenna 21 may be constituted by the plurality of multi-band antenna elements 20 arranged at unequal pitches.

In the first embodiment, by setting the transmission/reception changeover switches 66 and 69 (FIG. 2) to the neutral state, the corresponding multi-band antenna elements 20 are brought into the non-operation state. In addition, by making the power amplifier 67 and the low-noise amplifier 68 not to operate, the corresponding multi-band antenna elements 20 may be brought into the non-operation state. Further, an on/off switch may be inserted between the transmission/reception changeover switch 66 and the power amplifier 67, and between the low-noise amplifier 68 and the transmission/reception changeover switch 66. By turning on the on/off switch, the corresponding multi-band antenna elements 20 may be brought into the operation state, and by turning off the on/off switch, the corresponding multi-band antenna elements 20 may be brought into the non-operation state.

Second Embodiment

Next, an antenna module according to a second embodiment will be described with reference to FIG. 9A, FIG. 9B, and FIG. 9C. Hereinafter, the description of the configuration common to that of the antenna module according to the first embodiment will be omitted.

Figure 9A:
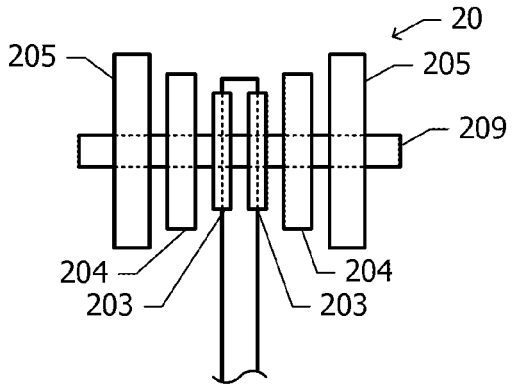
FIG. 9A, FIG. 9B, and FIG. 9C are plan views of one multi-band antenna element used in an antenna module according to a second embodiment and a modification thereof.

FIG. 9A is a plan view of one multi-band antenna element 20 used in an antenna module according to a second embodiment. In the first embodiment, each of the multi-band antenna elements 20 is constituted of the first conductor pattern 201 and the second conductor pattern 202 laminated in the thickness direction (FIG. 1B). The multi-band antenna element 20 according to the second embodiment is constituted of a plurality of conductor patterns 203, 204, and 205 having different dimensions disposed in the same plane.

In each of the multi-band antenna elements 20 according to the second embodiment, the smallest pair of the conductor patterns 203 is disposed in the innermost side, for example. A pair of the conductor patterns 204 that are larger than the pair of the conductor patterns 203 are disposed outside the pair of the conductor patterns 203. Further, the largest pair of the conductor patterns 205 are disposed outside the conductor patterns 204. The conductor patterns 203, 204, and 205 have a shape elongated in one direction respectively, and are disposed in parallel to one another. These conductor patterns 203, 204, 205 are coupled to a feed line 210 via a slot 209. The slot 209 is provided in a ground conductor disposed between the conductor patterns 203, 204, and 205 and the feed line 210 in the thickness direction. In the plan view, the slot 209 has a shape elongated in a direction substantially orthogonal to the longitudinal direction of each of the conductor patterns 203, 204, and 205, and intersects with each of the conductor patterns 203, 204, and 205. The multi-band antenna element 20 operates at three different frequencies corresponding to the dimensions of the conductor patterns 203, 204, and 205.

Figure 9B:
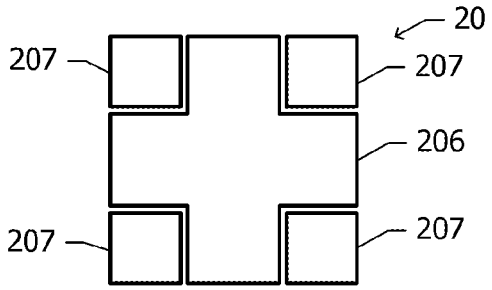

FIG. 9B is a plan view of one multi-band antenna element 20 of an antenna module according to a modification of the second embodiment. The multi-band antenna element 20 according to the present modification includes a conductor pattern 206 having a cross shape and a sub-array constituted of four conductor patterns 207. The conductor pattern 206 operates at a relatively low frequency, and the sub-array operates at a relatively high frequency.

Figure 9C:
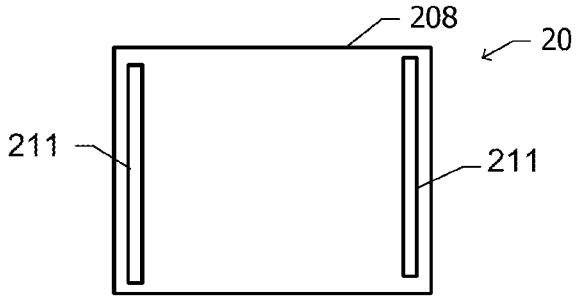

FIG. 9C is a plan view of one multi-band antenna element 20 of an antenna module according to another modification of the second embodiment. Each of the multi-band antenna elements 20 according to the present modification is constituted of a rectangular conductor pattern 208 having two slots 211 provided therein. The two slots 211 are arranged slightly inside the short sides of the rectangular conductor pattern 208, in parallel to the short sides. In the multi-band antenna element 20 according to the present modification, a first resonant mode and a third resonant mode are used.

In the first resonant mode, the amplitude of the current flowing in the longitudinal direction of the conductor pattern 208 becomes zero at both ends, and the point where the amplitude becomes the maximum appears in one place at the center in the longitudinal direction. In the third resonant mode, the points where the amplitude of the current flowing in the longitudinal direction of the conductor pattern 208 becomes the maximum appear in three places in the longitudinal direction, and the amplitude becomes zero between points at which the amplitude is maximum and at both ends. In the present modification, the region at both ends among the regions in which the current amplitude in the third resonant mode becomes the maximum is reduced by the slot 211, whereby the current distribution close to the current distribution in the first resonant mode is obtained in the third resonant mode. With this configuration, a multi-band operation is performed.

It is possible to obtain an excellent effect similar to that of the first embodiment even when the multi-band antenna element 20 according to the second embodiment or the modification thereof is used instead of the multi-band antenna element 20 of the antenna module according to the first embodiment (FIG. 1B). Further, other multi-band antenna elements may be used.

Third Embodiment

Next, an antenna module according to a third embodiment will be described with reference to FIG. 10A to FIG. 10E. Hereinafter, the description of the configuration common to that of the antenna module according to the first embodiment will be omitted.

Figure 10A:
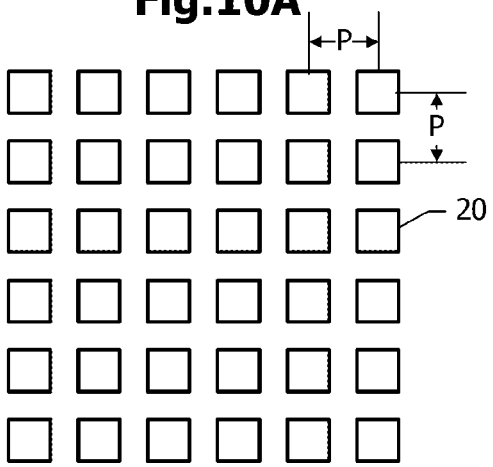
FIG. 10A is a plan view of a plurality of multi-band antenna elements of an antenna module according to a third embodiment.

FIG. 10A is a plan view of the plurality of multi-band antenna elements 20 of an antenna module according to a third embodiment. In the first embodiment, 16 multi-band antenna elements 20 (FIG. 1A) are arranged in a matrix with four rows and four columns. In the third embodiment, 36 multi-band antenna elements 20 are arranged in a matrix with six rows and six columns. The pitches in the row direction and the column direction are denoted by P.

Each of FIG. 10B to FIG. 10E is a diagram illustrating an example of a combination of the multi-band antenna elements 20 to be operated. In each of the drawings, the multi-band antenna elements 20 to be operated are hatched. The multi-band antenna elements 20, which are not hatched, are in the non-operation state.

Figure 10B:
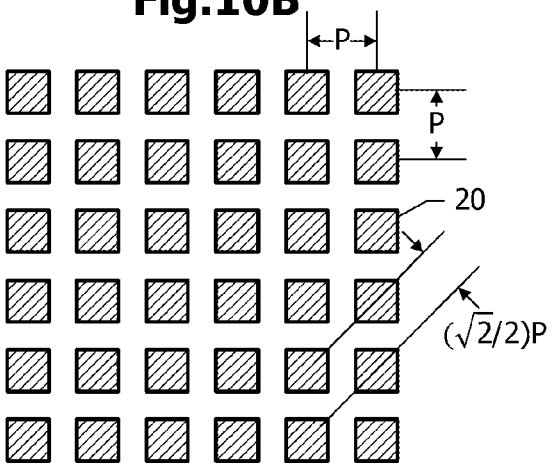
FIG. 10B, FIG. 10C, FIG. 10D, and FIG. 10E are diagrams illustrating an example of a combination of multi-band antenna elements to be operated, respectively.
Figure 10C:
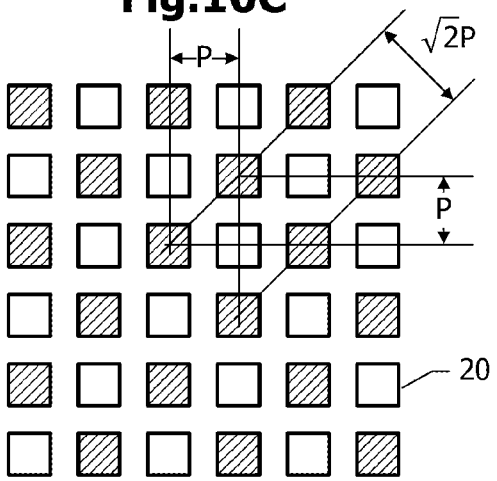

In the example illustrated in FIG. 10B, all of the multi-band antenna elements 20 are put into the operation state. The pitch of the multi-band antenna elements 20 in the operation state in the longitudinal direction and the lateral direction is P, and the pitch in the 45° oblique direction is equal to $(2^{1/2}/2)P$. Therefore, the maximum value of the pitch becomes P. In the example illustrated in FIG. 10C, the multi-band antenna elements 20 in the operation state and the multi-band antenna elements 20 in the non-operation state are arranged in a checkered pattern. In this case, the pitch of the multi-band antenna elements 20 in the operation state in the longitudinal direction and the lateral direction is P and the pitch in the 45° oblique direction is $2^{1/2}P$. The maximum value of the pitch is given as $2^{1/2}P$ which is the pitch of the two multi-band antenna elements 20 arranged in the oblique direction. In the example illustrated in FIG. 10D, the multi-band antenna elements 20 included in both of the odd-numbered row and the odd-numbered column are in the operation state, and the other multi-band antenna elements 20 are in the non-operation state. In this case, the pitch of the multi-band antenna elements 20 in the operation state in the lateral direction and the longitudinal direction is 2P and the pitch in the 45° oblique direction is $2^{1/2}P$. At this time, the maximum value of the pitch is given as the pitch 2P in the longitudinal direction and the lateral direction.

Figure 10D:
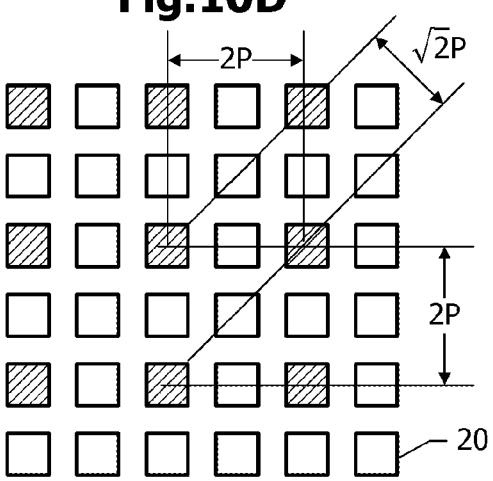
Figure 10E:
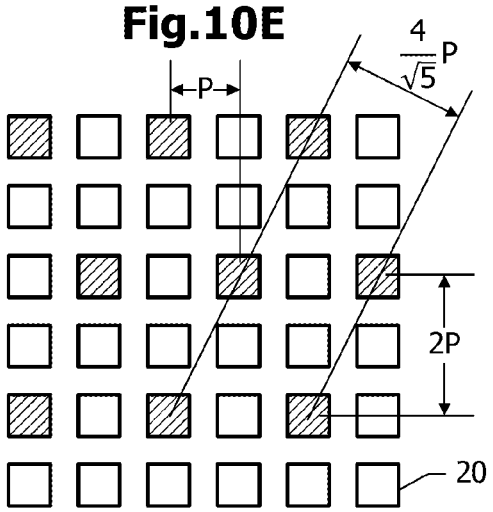

In the example illustrated in FIG. 10E, rows of the multi-band antenna elements all of which are set to be in the non-operation state are added between rows adjacent to each other in the longitudinal direction of the multi-band antenna elements forming the checkered pattern. Thus, the plurality of multi-band antenna elements 20 in the operation state has a relative positional relationship in which the pitch in the longitudinal direction is increased while maintaining the pitch in the lateral direction. In this case, the pitch of the multi-band antenna elements 20 in the lateral direction is P, and the pitch in the longitudinal direction is 2P. The pitch in the oblique direction is $(4/5^{1/2})P$. The maximum value of the pitch is given by 2P that is the pitch in the longitudinal direction.

In the examples of FIG. 10D and FIG. 10E, the maximum values of the pitches are the same, but the values of the pitches in other various directions are different from each other. Therefore, the directivity characteristic of the examples above in the operation state are different from each other. A combination in which a preferred directivity characteristic is obtained may be employed depending on the actual use form.

Next, an excellent effect of the third embodiment will be described.

In the third embodiment, it is possible to operate at three or more different frequencies by changing the maximum value of the pitch by variously changing the combination of the multi-band antenna elements 20 in the operation state. As examples illustrated in FIG. 10D and FIG. 10E, even when the maximum values of the pitches are the same, it is possible to differentiate the combination of the multi-band antenna elements 20 in the operation state. As described above, it is possible to obtain an effect that the degree of freedom of the combination of the multi-band antenna elements 20 to be in the operation state increases.

In the third embodiment, 36 multi-band antenna elements 20 are arranged in six rows and six columns, but the number of multi-band antenna elements 20 and the arrangement form thereof may be changed.

Fourth Embodiment

Next, an antenna module according to a fourth embodiment will be described with reference to FIG. 11A and FIG. 11B. Hereinafter, the description of the configuration common to that of the antenna module according to the first embodiment will be omitted.

Figure 11A:
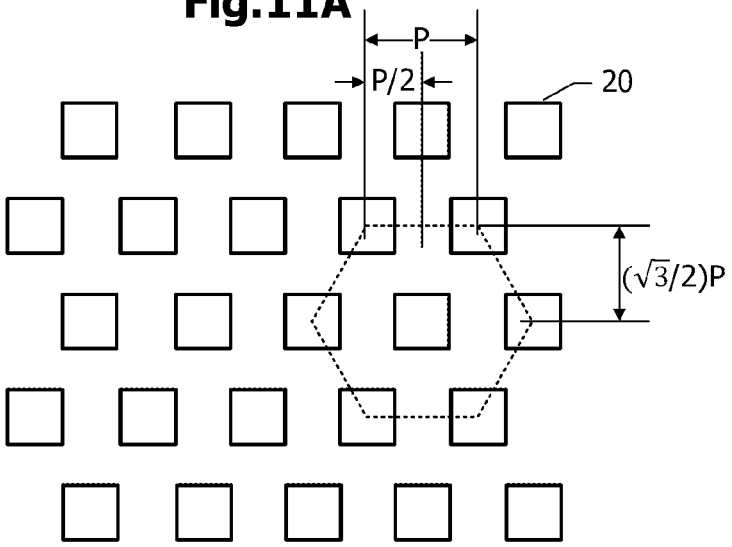
FIG. 11A is a plan view of the plurality of multi-band antenna elements of the antenna module according to the third embodiment.

FIG. 11A is a plan view of the plurality of multi-band antenna elements 20 of an antenna module according to a fourth embodiment. In the first embodiment, the plurality of multi-band antenna elements 20 (FIG. 1A) is arranged in a matrix, that is, in the grid points of a square grid. In the fourth embodiment, the plurality of multi-band antenna elements 20 is arranged at the positions of the grid points of a triangular grid. Focusing on one multi-band antenna element 20, arranged are six multi-band antenna elements 20 closest to the multi-band antenna element 20 of interest, and six closest multi-band antenna elements 20 are arranged at positions corresponding to vertices of a regular hexagon. The maximum value of the pitch of the multi-band antenna elements 20 is given by $((3^{1/2})/2)P$ when the length of one side of the regular hexagon is denoted as P.

When all of the multi-band antenna elements 20 are put into the operation state, the maximum value of the pitch of the multi-band antenna elements 20 in the operation state becomes equal to $((3^{1/2})/2)P$. At this time, it is preferable to operate the multi-band antenna elements 20 at an operation frequency determined by a wavelength that is two times the $((3^{1/2})/2)P$ that is the maximum value of the pitch.

Figure 11B:
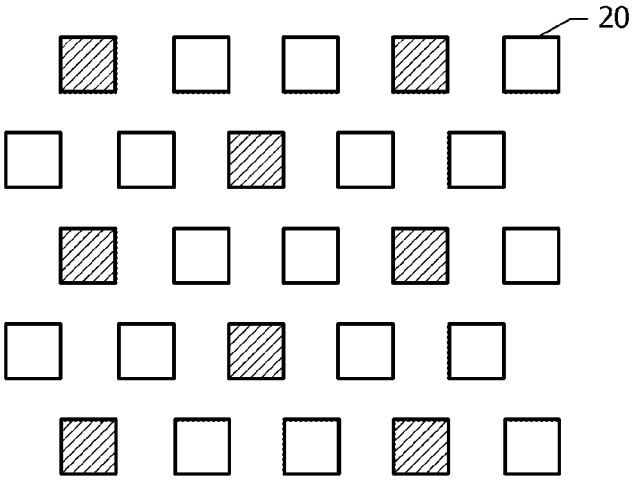
FIG. 11B is a diagram illustrating an example of a combination of the multi-band antenna elements to be operated.

FIG. 11B is a diagram illustrating an example in which some of the multi-band antenna elements 20 are operated. In FIG. 11B, the multi-band antenna elements 20 in the operation state are hatched. Also, in the fourth embodiment, the multi-band antenna elements 20 in the operation state may be selected so as to realize an optimum combination in accordance with the operation frequency.

Also, in the fourth embodiment, as with the first embodiment, it is possible to obtain an excellent effect that one array antenna is capable of supporting a plurality of frequencies. Further, when focusing on one multi-band antenna element 20, since the closest multi-band antenna elements 20 are arranged in six directions, it is possible to suppress the grating lobes in more azimuths than the arrangement in the matrix. As the result, it is possible to obtain an excellent effect that the aperture efficiency of the array antenna is increased.

Fifth Embodiment

An antenna module according to a fifth embodiment will be described with reference to FIG. 12.

Figure 12:
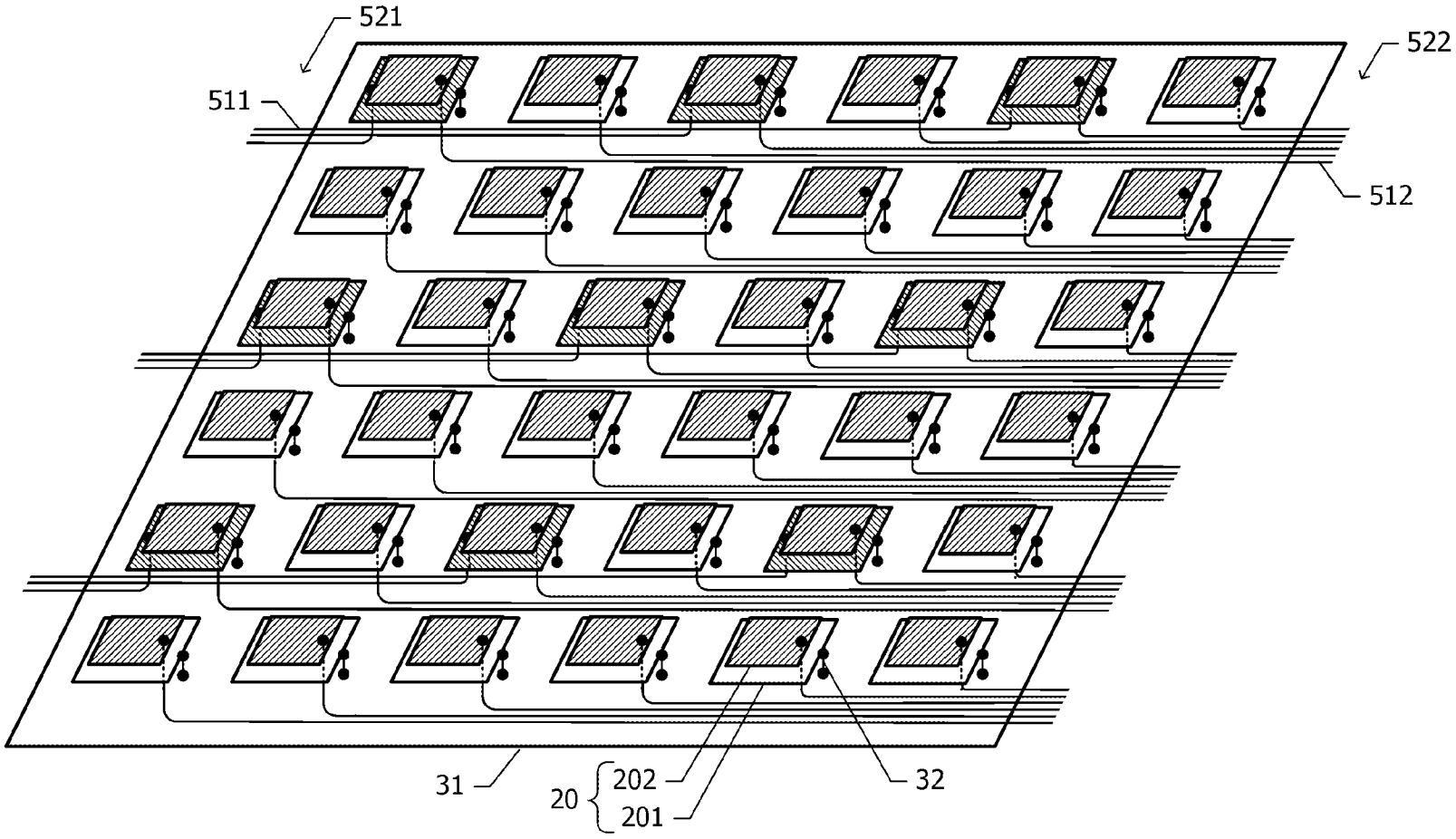
FIG. 12 is a perspective view of a conductor portion and a diagram illustrating a path of a feed line system of an antenna module according to a fifth embodiment.

FIG. 12 is a perspective view of a conductor portion and a diagram illustrating a path of a feed line system of an antenna module according to a fifth embodiment. The dielectric substrate is provided with the first ground conductor layer 31, a plurality of first conductor patterns 201, and a plurality of second conductor patterns 202. One first conductor pattern 201 and one second conductor pattern 202 form one multi-band antenna element 20.

When the thickness direction of the dielectric substrate is defined as the up-down direction, the first conductor pattern 201 is disposed above the first ground conductor layer 31. The plurality of first conductor patterns 201 is arranged at equal intervals in two directions (row direction and column direction) parallel to the upper surface of the dielectric substrate. The plurality of second conductor patterns 202 is disposed above the first conductor patterns 201 corresponding to the plurality of first conductor patterns 201. The second conductor pattern 202 is smaller than the first conductor pattern 201, and is disposed so as to at least partially overlap with the first conductor pattern 201 corresponding thereto in plan view. In FIG. 12, an example is illustrated in which the second conductor pattern 202 is disposed inside the first conductor pattern 201. The planer shape of each of the first conductor pattern 201 and the second conductor pattern 202 is a square shape or a rectangular shape.

A first feed line network 521 includes a plurality of first feed lines 511, and a second feed line network 522 includes a plurality of second feed lines 512. For example, a pad is provided as corresponding to each of the plurality of first feed lines 511 and the plurality of second feed lines 512, and the plurality of first feed lines 511 and the plurality of second feed lines 512 are connected to the radio frequency circuit via the pads. Some of the plurality of first conductor patterns 201 are coupled to the first feed lines 511 respectively, and the remaining first conductor patterns 201 are not coupled to the feed lines. With this configuration, some of the first conductor patterns 201 are selectively excited by the first feed line network 521. All of the second conductor patterns 202 are coupled to the second feed lines 512 respectively, and are excited by the second feed line network 522.

As an example, 36 first conductor patterns 201 and 36 second conductor patterns 202 are arranged in a matrix with six rows and six columns, respectively. The first feed line network 521 excites the first conductor patterns 201 positioned in the odd-numbered row and in the odd-numbered column at the same time. That is, the first conductor patterns 201 are excited every other row in the row direction and every other column in the column direction. In FIG. 12, the first conductor patterns 201 and the second conductor patterns 202 to be excited are hatched.

The plurality of first conductor patterns 201 is connected to the first ground conductor layer 31 using via conductors 32 provided in the dielectric substrate, respectively.

The plurality of first conductor patterns 201 excited by the first feed line network 521 constitutes a first array antenna. The plurality of second conductor patterns 202 constitutes a second array antenna. The resonant frequency of each of the second conductor patterns 202 is higher than the resonant frequency of each of the first conductor patterns 201. The second array antenna constituted by the second conductor patterns 202 operates in the frequency band higher than the frequency band in which the first array antenna constituted by the first conductor patterns 201 operates.

Next, an excellent effect obtained by adopting the configuration of the antenna module according to the fifth embodiment will be described.

The first array antenna and the second array antenna that operate at mutually different frequencies are arranged overlapping with each other in the thickness direction of the dielectric substrate, whereby it is possible to reduce the size of the multi-band antenna module that operates in two frequency bands.

The first conductor pattern 201 disposed below the second conductor pattern 202 is connected to the first ground conductor layer 31 by using the via conductor 32, and the dimension of the first conductor pattern 201 is deviated from a suitable dimension in accordance with the resonant frequency of the second conductor pattern 202. Therefore, when viewed from the first conductor pattern 201, the ground for antenna constituted by the second conductor patterns 202 is disposed immediately below the first conductor pattern 201.

The size of the first conductor pattern 201 that functions as the ground for antenna for the second conductor pattern 202 is determined by the antenna design. The size of the dielectric substrate depends on various factors that are independent from the characteristics required for the antenna. Therefore, the size of the actual ground for antenna may be different from the size of the ground for antenna at the time of the antenna design in some cases. When the size of the ground for antenna is different from the size at the time of design, the designed antenna characteristics may not be obtained. In this case, it is necessary to redo the antenna design. In the fifth embodiment, the size of the first conductor pattern 201, which is the ground for antenna viewed from the second conductor pattern 202, is determined at the time of design. Therefore, in the antenna using the second conductor pattern 202 as a radiating element, it is possible to ensure the designed antenna characteristics.

When viewed from the first conductor pattern 201, the first ground conductor layer 31 functions as the ground for antenna, and the via conductor 32 functions as a short pin that short-circuits the first conductor pattern 201 to the first ground conductor layer 31. Thus, the first conductor pattern 201 operates as a planar inverted-F antenna. With this configuration, when the operation frequency band is the same, it is possible to make the radiating element formed of the first conductor pattern 201 smaller than the radiating element of the patch antenna without the short pins.

By reducing each of the plurality of first conductor patterns 201 in size, it is possible to arrange the plurality of first conductor patterns 201 at narrow intervals. As the result, it is possible to reduce the interval between the second conductor patterns 202. By decreasing the arrangement period (pitch) of the plurality of second conductor patterns 202, it is possible to suppress the grating lobes. In order to sufficiently suppress the grating lobes, it is preferable to set the arrangement period of the second conductor patterns 202 to be equal to or less than the free space wavelength determined by the operation frequency.

When the plurality of second conductor patterns 202 is arranged at the suitable interval in accordance with the operation frequency of the second array antenna, the interval between the first conductor patterns 201 becomes narrower than the suitable interval in accordance with the operation frequency of the first array antenna. When the interval between the first conductor patterns 201 becomes narrower than the suitable interval, the isolation characteristic between the first conductor patterns 201 is deteriorated. In the fifth embodiment, since the plurality of first conductor patterns 201 is selectively excited every other row in the row direction and every other column in the column direction, it is possible to suppress the deterioration in the isolation characteristic.

Next, a modification of the fifth embodiment will be described.

In the fifth embodiment, the plurality of first conductor patterns 201 is excited at every other row in the row direction and every other column in the column direction, but the first conductor patterns 201 may be excited at every third or higher order row in the row direction and every third or higher order column in the column direction. The interval between the first conductor patterns 201 that are targets to be excited may be set to a suitable value in accordance with the operation frequency of the first array antenna.

In the fifth embodiment, the 36 first conductor patterns 201 and the 36 second conductor patterns 202 are arranged in a matrix with six rows and six columns, but the number of the first conductor patterns 201 and the second conductor patterns 202 are not limited to 36. For example, more generally, the conductor patterns may be arranged in a matrix with n rows and m columns. Here, n and m are integers equal to or greater than one. Further, the first conductor pattern 201 and the second conductor pattern 202 are not necessarily arranged in a matrix.

In the fifth embodiment, each of the multi-band antenna elements 20 includes two conductor patterns corresponding to two operation frequencies, that is, the first conductor pattern 201 and the second conductor pattern 202. By adopting the configuration that each of the plurality of multi-band antenna elements 20 includes three or more conductor patterns respectively corresponding to three or more operation frequencies, it is also possible to realize an antenna module capable of operating at three or more operation frequencies.

In the antenna module according to the modification of the fifth embodiment capable of operating at two or more operation frequencies, when one operation frequency is selected from the plurality of operation frequencies, the multi-band antenna elements 20 including the conductor patterns coupled to the feed lines among the plurality of conductor patterns corresponding to the selected operation frequency become the power feed targets, and no power is fed to the remaining multi-band antenna elements 20. In other words, in the antenna module according to the present modification of the fifth embodiment, among the conductor patterns corresponding to the selected operation frequency, the conductor patterns of the multi-band antenna elements 20 selected as the power feed targets are coupled to the feed lines, and the conductor patterns of the remaining multi-band antenna elements 20 are not coupled to the feed lines. The conductor pattern operates as an antenna by being coupled to one of the plurality of feed lines. When the selected operation frequency changes, the combination of the multiple multi-band antenna elements 20, which include the conductor patterns coupled to the feed lines among the conductor patterns corresponding to the selected operation frequency, also changes.

In the fifth embodiment, the first feed line 511 is coupled to only some of the first conductor patterns 201 to be excited among the plurality of first conductor patterns 201. However, the first feed lines 511 may be coupled to all of the first conductor patterns 201, respectively. In this case, the power is fed to the first conductor patterns 201 via the first feed lines 511 coupled to the first conductor patterns 201 to be excited, and no power is fed via other first feed lines 511. The function of feeding power via some of the first feed lines 511 and not feeding power via other feed lines may be provided to the radio frequency integrated circuit element connected to the first feed lines 511.

Sixth Embodiment

Next, an antenna module according to a sixth embodiment will be described with reference to FIG. 13A and FIG. 13B. Hereinafter, the description of the configuration common to the antenna module according to the fifth embodiment (FIG. 12) will be omitted.

Figure 13A:
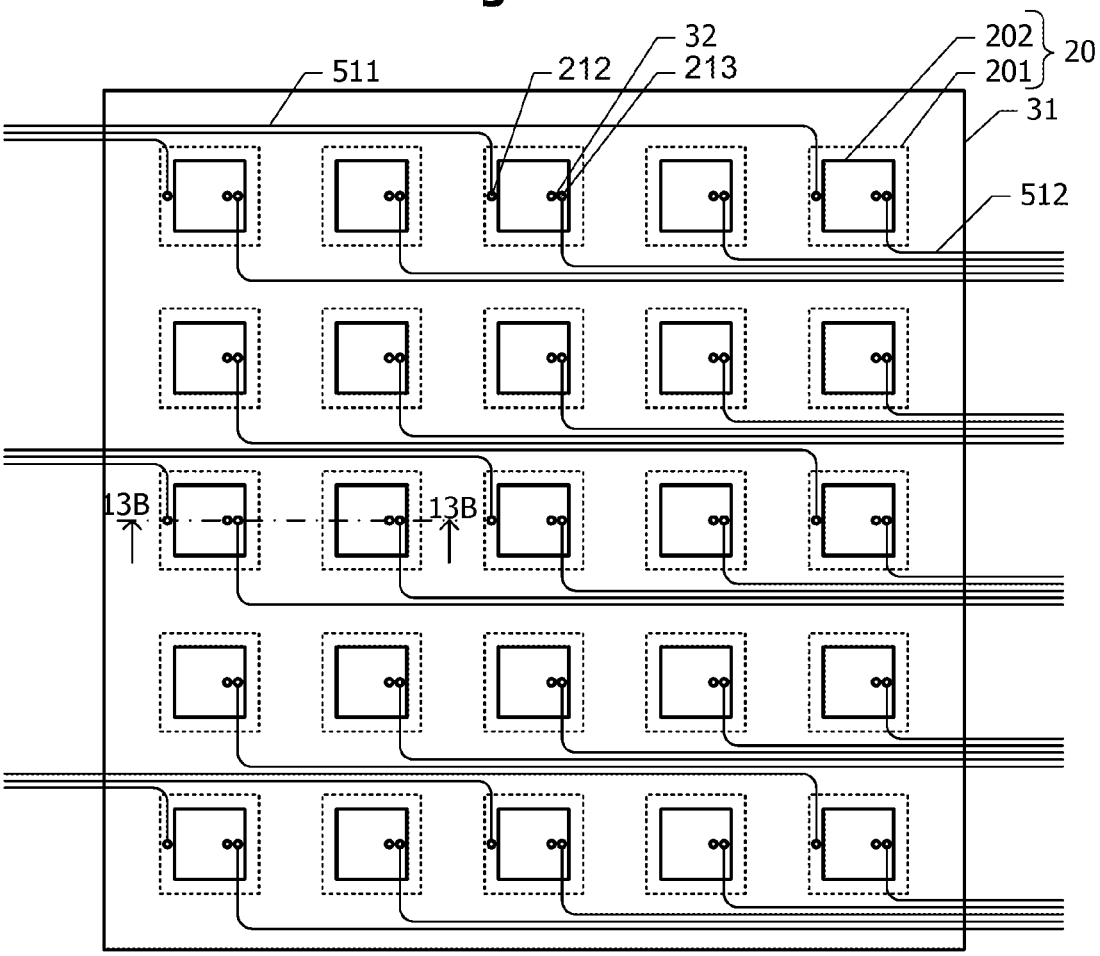
FIG. 13A is a plan view of an antenna module according to a sixth embodiment and a schematic view illustrating a connection aspect of a feed line.

FIG. 13A is a plan view of an antenna module according to a sixth embodiment, and schematically illustrates a connection form of feed lines. In the fifth embodiment, the multi-band antenna elements 20 constituted of the first conductor pattern 201 and the second conductor pattern 202 are respectively arranged in a matrix with six rows and six columns, but in the sixth embodiment, the multi-band antenna elements 20 are arranged in a matrix with five rows and five columns.

In plan view, the second conductor pattern 202 overlaps with the first conductor pattern 201 disposed at the corresponding position, and is disposed inside the first conductor pattern 201. The plurality of first conductor patterns 201 is disposed inside the outer peripheral line of the first ground conductor layer 31 in plan view.

The plurality of first feed lines 511 is coupled to the first conductor patterns 201 to be excited at first coupling points 212, respectively. As the first conductor patterns 201 to be excited, the first conductor patterns 201 in the odd-numbered row and in the odd-numbered column at the same time are selected. The plurality of second feed lines 512 is coupled to the plurality of second conductor patterns 202 at second coupling points 213, respectively. The via conductor 32 that connects the first conductor pattern 201 and the first ground conductor layer 31 is disposed between the first coupling point 212 and the second coupling point 213 in plan view.

In FIG. 13A, the first feed lines 511 and the second feed lines 512 are described as not overlapping with each other, but actually, the first feed lines 511 and the second feed lines 512 may be disposed over a plurality of inner layers in the dielectric substrate, and may overlap with or intersect with each other in plan view.

Figure 13B:
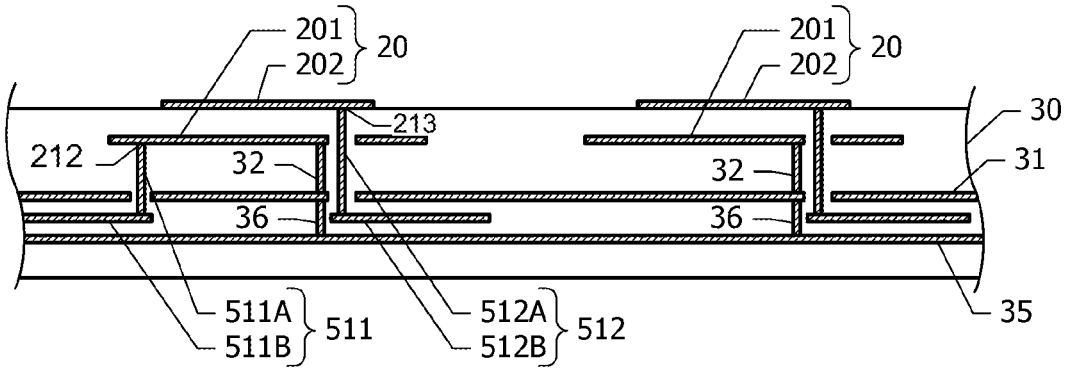
FIG. 13B is a sectional view taken along the dash-dotted line 13B-13B in FIG. 13A.

FIG. 13B is a sectional view taken along the dash-dotted line 13B-13B in FIG. 13A. The first ground conductor layer 31 is provided in the inner layer of the dielectric substrate 30. When the thickness direction of the dielectric substrate 30 is defined as the up-down direction, the first conductor patterns 201 are disposed above the first ground conductor layer 31, and the second conductor patterns 202 are disposed above the first conductor patterns 201. The via conductor 32 is provided for each of the first conductor patterns 201, and the via conductor 32 connects the corresponding first conductor pattern 201 to the first ground conductor layer 31.

Another ground conductor layer 35 is provided below the first ground conductor layer 31. The ground conductor layer 35 is connected to the first ground conductor layer 31 by a ground via conductor 36. Wiring lines 511B and 512B are provided between the first ground conductor layer 31 and the ground conductor layer 35 below the first ground conductor layer 31.

A via conductor 511A extends upward from the lower side of the first ground conductor layer 31 passing through an opening (clearance hole) provided in the first ground conductor layer 31, and is coupled to the first coupling point 212 of the first conductor pattern 201. The via conductor 511A and the wiring line 511B constitute the first feed line 511.

A via conductor 512A extends upward from the lower side of the first ground conductor layer 31 passing through an opening (clearance hole) provided in the first ground conductor layer 31. Further, the via conductor 512A extends upward from the lower side of the first conductor pattern 201 passing through an opening (clearance hole) provided in the first conductor pattern 201, and is coupled to the second coupling point 213 of the second conductor pattern 202. The via conductor 512A and the wiring line 512B constitute the second feed line 512. When focusing on the one multi-band antenna element 20, the via conductor 32 that connects the first conductor pattern 201 to the first ground conductor layer 31 is disposed between the via conductor 511A that is part of the first feed line 511 and the via conductor 512A that is part of the second feed line 512.

Next, an excellent effect obtained by adopting the configuration of the antenna module according to the sixth embodiment will be described.

Also, in the sixth embodiment, it is possible to obtain the same effect as that of the fifth embodiment (FIG. 12). Further, in the sixth embodiment, the via conductor 32 connected to the first ground conductor layer 31 is disposed between the via conductor 511A that is part of the first feed line 511 and the via conductor 512A that is part of the second feed line 512. Accordingly, it is possible to ensure the sufficient isolation between the first feed line 511 and the second feed line 512.

Seventh Embodiment

Next, an antenna module according to a seventh embodiment will be described with reference to FIG. 14A and FIG. 14B. Hereinafter, the description of the configuration common to the antenna module according to the sixth embodiment (FIG. 13A and FIG. 13B) will be omitted.

Figure 14A:
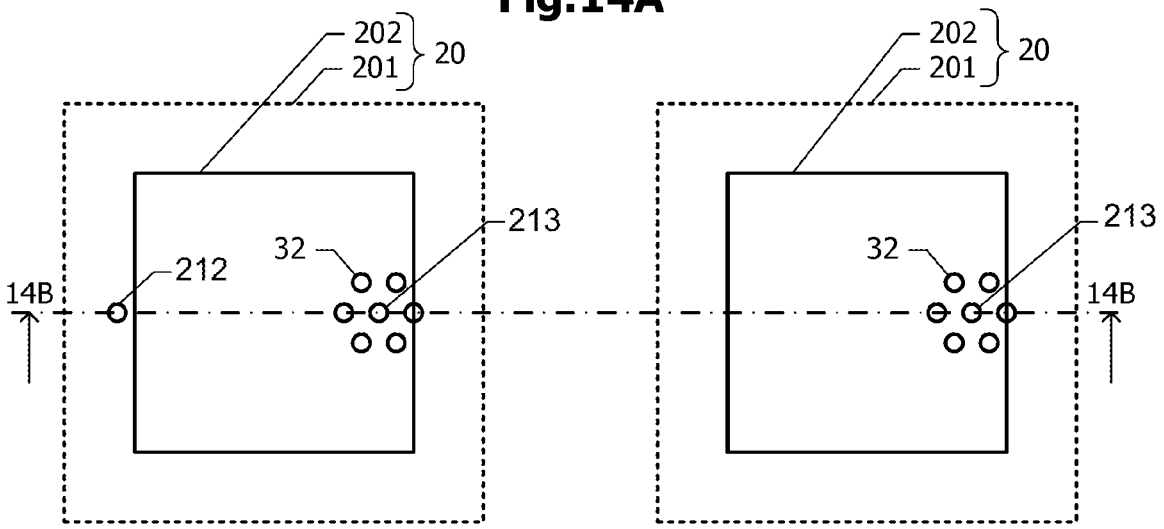
FIG. 14A is a plan view of regions of two first conductor patterns of an antenna module according to a seventh embodiment.

FIG. 14A is a plan view of two multi-band antenna elements 20 of the antenna module according to the seventh embodiment. In plan view, the second conductor pattern 202 is disposed inside the first conductor pattern 201. In FIG. 14A, the first conductor pattern 201 in the left side is the excitation target, and the first conductor pattern 201 in the right side is not the excitation target. In the sixth embodiment, one via conductor 32 (FIG. 13A) is provided for each of the plurality of first conductor patterns 201. Whereas, in the seventh embodiment, a plurality of, for example, six via conductors 32 are provided for each of the first conductor patterns 201. In plan view, the plurality of via conductors 32 is disposed so as to surround the second coupling point 213. For example, the plurality of via conductors 32 is arranged with equal intervals on a circumference centered at the second coupling point 213.

Figure 14B:
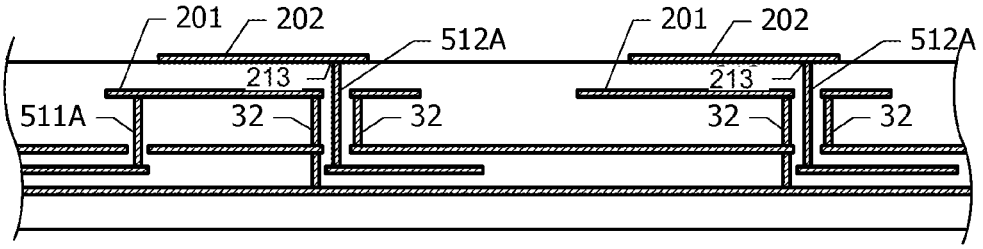
FIG. 14B is a sectional view taken along the dash-dotted line 14B-14B in FIG. 14A.

FIG. 14B is a sectional view taken along the dash-dotted line 14B-14B in FIG. 14A. In the cross-section illustrated in FIG. 14B, the via conductors 32 are respectively disposed on each side of the via conductor 512A of the second feed line 512.

Next, an excellent effect obtained by adopting the configuration of the antenna module according to the seventh embodiment will be described. In the sixth embodiment, it is possible to ensure the isolation between the via conductor 511A and the via conductor 512A corresponding to each other that are respectively connected to the first conductor pattern 201 and the second conductor pattern 202. In the seventh embodiment, it is possible to shield the via conductor 512A in all azimuths, as well as to ensure the isolation between the via conductor 511A and the via conductor 512A corresponding to each other.

Eighth Embodiment

Next, an antenna module according to an eighth embodiment will be described with reference to FIG. 15A. Hereinafter, the description of the configuration common to the antenna module according to the sixth embodiment (FIG. 13A and FIG. 13B) will be omitted.

Figure 15A:
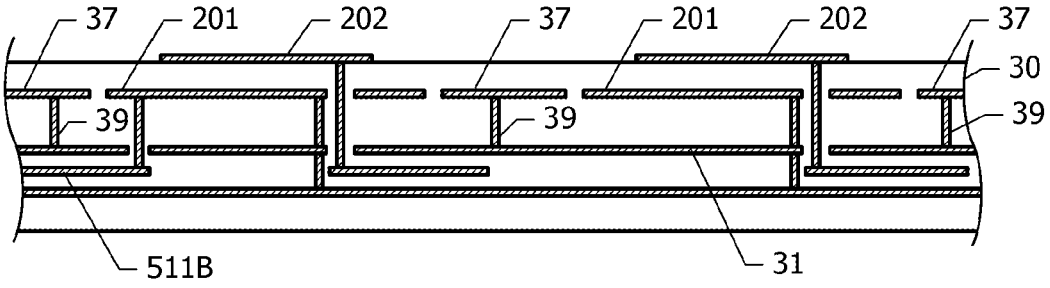
FIG. 15A is a sectional view of an antenna module according to an eighth embodiment, and FIG. 15B and FIG.

FIG. 15A is a sectional view of the antenna module according to the eighth embodiment. In the sixth embodiment, the ground conductor layer is not provided above the first ground conductor layer 31 (FIG. 13B). In the eighth embodiment, a second ground conductor layer 37 is provided in the same layer as the first conductor pattern 201. A gap is provided between the second ground conductor layer 37 and the first conductor pattern 201. The second ground conductor layer 37 is connected to the first ground conductor layer 31 below the second ground conductor layer 37 using a ground via conductor 39.

Next, an excellent effect obtained by adopting the configuration of the antenna module according to the eighth embodiment will be described. In the eighth embodiment, the second ground conductor layer 37 is disposed in the same layer as the first conductor pattern 201, but both are not connected to each other in the same layer. Accordingly, as with the fifth embodiment, the dimension of the first conductor pattern 201, which substantially functions as the ground for the second conductor pattern 202, does not depend on the size of the dielectric substrate 30. Therefore, even when the size of the dielectric substrate 30 is changed from the precondition of the antenna design, it is possible to ensure the desired antenna characteristics.

Further, it is possible to dispose a strip line between the first ground conductor layer 31 and the second ground conductor layer 37.

Figure 15B:
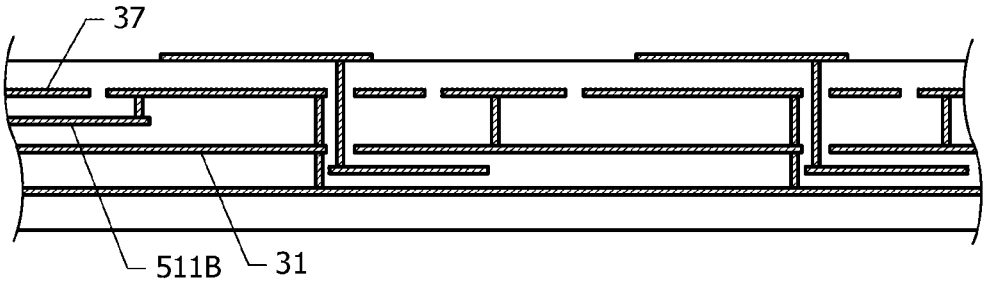

FIG. 15B is a sectional view of an antenna module according to a modification of the eighth embodiment. In the eighth embodiment, the wiring line 511B that is part of the first feed line 511 (FIG. 15A) is disposed below the first ground conductor layer 31. In the modification illustrated in FIG. 15B, the wiring line 511B is disposed between the first ground conductor layer 31 and the second ground conductor layer 37. In the present modification, since the wiring line 511B is disposed above the first ground conductor layer 31, it is possible to obtain an effect that routing of the wiring line is facilitated compared with a configuration in which the wiring line is disposed only below the first ground conductor layer 31.

Figure 15C:
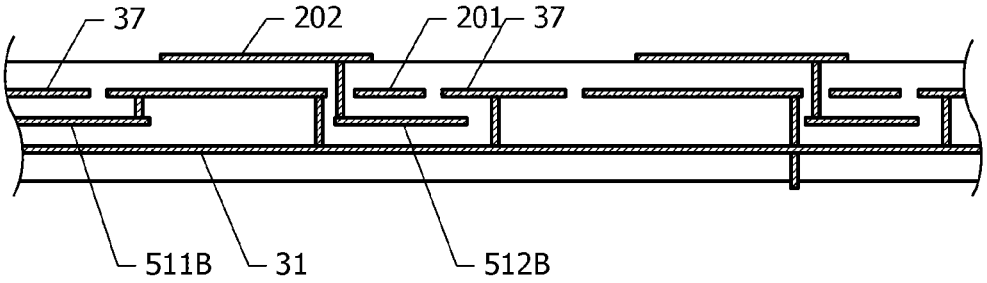

As illustrated in FIG. 15C, the wiring line 512B of the second feed line 512 coupled to the second conductor pattern 202 as well as the wiring line 511B may be arranged between the first ground conductor layer 31 and the second ground conductor layer 37.

Ninth Embodiment

Next, an antenna module according to a ninth embodiment will be described with reference to FIG. 16A. Hereinafter, the description of the configuration common to the antenna module according to the sixth embodiment (FIG. 13A and FIG. 13B) will be omitted.

FIG. 16A is a sectional view of the antenna module according to the ninth embodiment. In the ninth embodiment, a first radio frequency integrated circuit 41 and a second radio frequency integrated circuit 42 are mounted on the lower surface of the dielectric substrate 30. The first radio frequency integrated circuit 41 is connected to some of the first conductor patterns 201 using the first feed lines 511, and transmits/receives a radio frequency signal to/from the first conductor patterns 201. The second radio frequency integrated circuit 42 is connected to the second conductor patterns 202 using the second feed lines 512, and transmits/receives a radio frequency signal to/from the second conductor patterns 202.

The other ground conductor layer 35 is provided below the first ground conductor layer 31 and further, another ground conductor layer 38 is provided below the ground conductor layer 35. The wiring lines constituting the first feed lines 511 are disposed between the ground conductor layer 35 and the ground conductor layer 38, and the wiring lines constituting the second feed lines 512 are disposed between the first ground conductor layer 31 and the ground conductor layer 35.

Next, an excellent effect obtained by adopting the configuration of the antenna module according to the ninth embodiment will be described. In the ninth embodiment, it is possible to reduce the size compared with the configuration in which the antenna module according to the sixth embodiment (FIG. 13A and FIG. 13B) and the radio frequency integrated circuit are mounted on a mounting substrate such as a motherboard, and the antenna module and the radio frequency integrated circuit are connected by a wiring line on the motherboard. Further, by configuring the first radio frequency integrated circuit 41 and the second radio frequency integrated circuit 42 by independent integrated circuit elements, it is possible to easily ensure the sufficient isolation between frequencies. For example, when the operation frequency bands of the first conductor pattern 201 and the second conductor pattern 202 are the 28 GHz band and the 60 GHz band, respectively, it is possible to prevent the mutual interference between the radio frequency circuit for the 28 GHz band and the radio frequency circuit for the 60 GHz band.

In addition to the first radio frequency integrated circuit 41 and the second radio frequency integrated circuit 42, a resistance element, an inductor, a capacitor, a baseband integrated circuit, a DC-DC converter, and the like may be mounted on the dielectric substrate 30. The first radio frequency integrated circuit 41, the second radio frequency integrated circuit 42, and the like may be shielded, as necessary. For example, it is preferable to cover the first radio frequency integrated circuit 41, the second radio frequency integrated circuit 42, and the like with a shield can. Alternatively, the first radio frequency integrated circuit 41, the second radio frequency integrated circuit 42, and the like may be sealed with sealing resin, and a shielding conductor film may be formed on the surface of the sealing resin.

Next, an antenna module according to a first modification of the ninth embodiment will be described with reference to FIG. 16B.

FIG. 16B is a sectional view of the antenna module according to the first modification of the ninth embodiment. In the ninth embodiment, the first radio frequency integrated circuit 41 that excites the first conductor pattern 201 and the second radio frequency integrated circuit 42 that excites the second conductor pattern 202 are configured by the independent elements, but in the present modification, the functions of both of the elements are realized by one integrated circuit element 43. As illustrated in FIG. 16B, the integrated circuit element 43 includes both a first radio frequency circuit that excites the first conductor pattern 201 and a second radio frequency circuit that excites the second conductor pattern 202. In the first modification of the ninth embodiment, it is possible to reduce the number of components as compared with the ninth embodiment.

In the first modification of the ninth embodiment, the first feed line 511 and the second feed line 512 are disposed in layers that are different from each other, but they may be arranged in the same layer. Further, each of the first feed line 511 and the second feed line 512 may be disposed across a plurality of layers.

Next, an antenna module according to a second modification of the ninth embodiment will be described with reference to FIG. 17.

FIG. 17 is a sectional view of the antenna module according to the second modification of the ninth embodiment. An integrated circuit element 44 is mounted on the lower surface of the dielectric substrate 30. In the first modification of the ninth embodiment (FIG. 16B), the first feed line 511 is connected to some of the first conductor patterns 201, but in the second modification, the feed lines are not connected to any of the first conductor patterns 201. That is, each of the multi-band antenna elements 20 has the same structure as that of the multi-band antenna element 20 of the antenna module according to the first embodiment (FIG. 1B). The second conductor patterns 202 of all of the multi-band antenna elements 20 are connected to the integrated circuit element 44 by the second feed lines 512. The integrated circuit element 44 includes the function of the radio frequency integrated circuit element 52 of the antenna module according to the first embodiment (FIG. 2).

The integrated circuit element 44 selects the multi-band antenna elements 20 to be operated from the plurality of multi-band antenna elements 20 in accordance with the frequency of the radio wave transmitted/received, and feeds power to the second conductor patterns 202 of the selected multi-band antenna elements 20. No power is fed to the second conductor patterns 202 of the multi-band antenna elements 20 that are not selected. In the second modification of the ninth embodiment, the one integrated circuit element 44 is capable of operating the multi-band antenna element 20 at a plurality of operation frequencies. Therefore, in the second modification, as in the first modification, it is possible to reduce the number of components as compared with the ninth embodiment.

Reference Example

Next, an antenna module according to a reference example will be described with reference to FIG. 18. Hereinafter, the description of the configuration common to the antenna module according to the eighth embodiment (FIG. 15A) will be omitted.

FIG. 18 is a sectional view of the antenna module according to the reference example. In the eighth embodiment (FIG. 15A), the plurality of first conductor patterns 201 and the plurality of second conductor patterns 202 are respectively disposed and constitute the first array antenna and the second array antenna. In the reference example, one first conductor pattern 201 and one second conductor pattern 202 are disposed. The plurality of via conductors 32 that connect the second conductor pattern 202 and the first ground conductor layer 31 is disposed so as to surround the via conductor 512A that constitutes part of the second feed line 512 in plan view. The wiring line 511B that constitutes part of the first feed line 511 is disposed between the first ground conductor layer 31 and the second ground conductor layer 37.

Next, an excellent effect obtained by adopting the configuration of the antenna module according to the reference example will be described.

Also, in the reference example, as with the eighth embodiment, the second ground conductor layer 37 is separated from the first conductor pattern 201 in the same layer. With this configuration, the dimension of the first conductor pattern 201 that functions as the ground for antenna of the second conductor pattern 202 is fixed regardless of the dimension of the dielectric substrate 30. Therefore, it is possible to suppress the change of the characteristics of the antenna, in which the second conductor pattern 202 is the radiating element, from the desired characteristics at the time of antenna design.

It is needless to say that the embodiments described above are illustrative and that partial substitutions or combinations of the configurations described in different embodiments may be possible. Similar operational effects according to the similar configuration in the plurality of embodiments will not be described one by one for each embodiment. Further, the present disclosure is not limited to the above-described embodiments. For example, it will be apparent to those skilled in the art that various modifications, improvements, combinations, and the like may be made.

20 MULTI-BAND ANTENNA ELEMENT
21 ARRAY ANTENNA
30 DIELECTRIC SUBSTRATE
31 FIRST GROUND CONDUCTOR LAYER
32 VIA CONDUCTOR
35 GROUND CONDUCTOR LAYER
36 GROUND VIA CONDUCTOR
37 SECOND GROUND CONDUCTOR LAYER
38 GROUND CONDUCTOR LAYER
39 GROUND VIA CONDUCTOR
41 FIRST RADIO FREQUENCY INTEGRATED CIRCUIT (FIRST RFIC)
42 SECOND RADIO FREQUENCY INTEGRATED CIRCUIT (SECOND RFIC)
43, 44 INTEGRATED CIRCUIT ELEMENT
50 ANTENNA DRIVE UNIT
51 FEED LINE
52 RADIO FREQUENCY INTEGRATED CIRCUIT ELEMENT (RFIC)
53 BASEBAND INTEGRATED CIRCUIT ELEMENT (BBIC)

54 CONTROLLER
60 INTERMEDIATE FREQUENCY AMPLIFIER
61 UP-DOWN CONVERSION MIXER
62 TRANSMISSION/RECEPTION CHANGEOVER SWITCH
63 POWER DIVIDER
64 PHASE SHIFTER
65 ATTENUATOR
66 TRANSMISSION/RECEPTION CHANGEOVER SWITCH
67 POWER AMPLIFIER
68 LOW-NOISE AMPLIFIER
69 TRANSMISSION/RECEPTION CHANGEOVER SWITCH
201 FIRST CONDUCTOR PATTERN
202 SECOND CONDUCTOR PATTERN
203, 204, 205, 206, 207, 208 CONDUCTOR PATTERN
209 SLOT
210 FEED LINE
211 SLOT
212 FIRST COUPLING POINT
213 SECOND COUPLING POINT
511 FIRST FEED LINE
511A VIA CONDUCTOR
511B WIRING LINE
512 SECOND FEED LINE
512A VIA CONDUCTOR
512B WIRING LINE
521 FIRST FEED LINE NETWORK
522 SECOND FEED LINE NETWORK

The invention claimed is:

1. An antenna module comprising:

an array antenna comprising a plurality of multi-band unit antennas, each multi-band unit antenna constituting a single array element of the array antenna, and the array antenna being configured to operate at a plurality of operation frequencies; and an antenna driver configured to select at least two multi-band unit antennas in accordance with a selected operation frequency, and to operate the selected multi-band unit antennas, wherein the antenna driver comprises a plurality of feed lines, wherein each of the plurality of multi-band unit antennas comprises a plurality of conductor patterns, and for each of the plurality of multi-band unit antennas, each of the plurality of conductor patterns are configured to radiate radio frequency signals at different frequencies, and wherein the conductor patterns of the selected multi-band unit antennas are configured to radiate a radio frequency signal at the selected operation frequency, and are coupled to one of the plurality of feed lines.

2. The antenna module according to claim 1, wherein a maximum value of a pitch of the plurality of multi-band unit antennas is less than a free space wavelength corresponding to a highest one of the plurality of operation frequencies.

3. The antenna module according to claim 1, wherein the antenna driver comprises:

a controller configured to output a selection signal configured to select a combination of the at least two multi-band unit antennas in accordance the selected operation frequency, and a radio frequency integrated circuit configured to feed power to the selected multi-band unit antennas, and to not feed power to non-selected multi-band unit antennas, based on the selection signal.

4. The antenna module according to claim 3, wherein the radio frequency integrated circuit is configured to input the radio frequency signal to the selected multi-band unit antennas, and to not input the radio frequency signal to the non-selected multi-band unit antennas.

5. The antenna module according to claim 1, wherein the conductor patterns of the non-selected multi-band unit antennas are not coupled to any of the plurality of feed lines.

6. The antenna module according to claim 1, wherein the plurality of multi-band unit antennas are arranged in a two-dimensional matrix.

7. The antenna module according to claim 1, wherein the plurality of multi-band unit antennas are arranged at positions corresponding to a triangular grid.

8. The antenna module according to claim 1, wherein the antenna driver is configured to select the at least two multi-band unit antennas such that a maximum value of a pitch of the selected multi-band unit antennas is equal to or less than a free space wavelength corresponding to the selected operation frequency.

9. The antenna module according to claim 1, further comprising:

a dielectric substrate in or on which the plurality of multi-band unit antennas are located; and a first ground conductor layer in the dielectric substrate, wherein:

each of the plurality of multi-band unit antennas comprises:

a first conductor pattern above the first ground conductor layer in a thickness direction of the dielectric substrate, and a second conductor pattern above the first conductor pattern so as to overlap the first conductor pattern when the antenna module is seen in a plan view, and the antenna driver comprises:

a first feed line network configured to selectively excite the first conductor patterns of the selected multi-band unit antennas, and to not excite the first conductor patterns of the non-selected multi-band unit antennas, and a second feed line network configured to excite the second conductor patterns of all of the plurality of multi-band unit antennas.

10. The antenna module according to claim 9, wherein each of the plurality of multi-band unit antennas further comprises a via conductor that connects the first conductor pattern to the first ground conductor layer.

11. The antenna module according to claim 10, wherein:

the first feed line network comprises a first feed line coupled to the first conductor pattern of the selected multi-band unit antennas, and the second feed line network comprises a second feed line that extends from a lower side to an upper side of the first conductor pattern, and that is coupled to the second conductor pattern.

12. The antenna module according to claim 11, wherein in each of the plurality of multi-band unit antennas, the via conductor is between a first coupling point and a second coupling point, the first coupling point being where the first conductor pattern and the first feed line are coupled, and the second coupling point being where the second conductor pattern and the second feed line are coupled.

13. The antenna module according to claim 12, wherein the via conductors surround the second coupling point when the antenna module is seen in the plan view.

14. The antenna module according to claim 9, further comprising a second ground conductor layer that is in a same layer as the first conductor pattern, and that is connected to the first ground conductor layer.

15. The antenna module according to claim 9, wherein:

the first feed line network comprises a first radio frequency integrated circuit that is mounted on the dielectric substrate and that is configured to transmit and receive the radio frequency signals, respectively, to and from the first conductor pattern, and the second feed line network comprises a second radio frequency integrated circuit that is mounted on the dielectric substrate, and that is configured to transmit and receive the radio frequency signals, respectively, to and from the second conductor pattern.

16. The antenna module according to claim 9, wherein:

the first feed line network and the second feed line network comprise, respectively, a first radio frequency circuit configured to excite the first conductor pattern and a second radio frequency circuit configured to excite the second conductor pattern, and the first radio frequency circuit and the second radio frequency circuit are in a single integrated circuit.

* * * * *